US007413293B2

(12) United States Patent
Jeanmaire

(10) Patent No.: US 7,413,293 B2
(45) Date of Patent: Aug. 19, 2008

(54) DEFLECTED DROP LIQUID PATTERN DEPOSITION APPARATUS AND METHODS

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/417,458

(22) Filed: May 4, 2006

(65) Prior Publication Data

US 2007/0257971 A1 Nov. 8, 2007

(51) Int. Cl.
*B41J 2/09* (2006.01)

(52) U.S. Cl. ..... 347/77

(58) Field of Classification Search ..... 347/77, 347/73, 74, 75, 76, 78, 80–82, 90
See application file for complete search history.

(56) References Cited

U.S. PATENT DOCUMENTS

| | | | | |
|---|---|---|---|---|
| 1,521,874 | A | 1/1925 | Dygert | |
| 3,709,432 | A | 1/1973 | Robertson | 239/4 |
| 4,190,844 | A | 2/1980 | Taylor | 347/82 |
| 4,914,522 | A | 4/1990 | Duffield et al. | 358/296 |
| 5,963,235 | A | 10/1999 | Chwalek et al. | 347/82 |
| 6,079,821 | A | 6/2000 | Chwalek et al. | 347/82 |
| 6,450,628 | B1 * | 9/2002 | Jeanmaire et al. | 347/75 |
| 6,474,795 | B1 | 11/2002 | Lebens et al. | 347/82 |
| 6,505,921 | B2 | 1/2003 | Chwalek et al. | 347/77 |
| 6,508,542 | B2 | 1/2003 | Sharma et al. | 347/77 |
| 6,509,917 | B1 | 1/2003 | Chwalek et al. | 347/82 |
| 2002/0085073 | A1 * | 7/2002 | Chwalek et al. | 347/77 |
| 2003/0222950 | A1 * | 12/2003 | Jeanmaire | 347/77 |

FOREIGN PATENT DOCUMENTS

EP 0 494 385 7/1992

* cited by examiner

*Primary Examiner*—K. Feggins
(74) *Attorney, Agent, or Firm*—Stephen F. Pond; William R. Zimmerli

(57) ABSTRACT

Drop deflector apparatus and methods for a continuous drop emission system comprising a plurality of drop nozzles emitting a plurality of continuous streams of a liquid that break up into streams of drops of substantially uniform drop volume having nominal flight paths that are substantially within a nominal flight plane are disclosed. A plurality of path selection elements corresponding to the plurality of continuous streams of drops is provided operable to firstly deflect individual drops from the corresponding continuous stream of drops along a first deflection flight path diverging from the nominal flight path based on pattern data. A plurality of gas nozzles is provided which generate a plurality of localized gas flows, positioned along one of the first deflection flight paths or the nominal flight paths, wherein the localized gas flows are oriented so as to cause a substantial second deflection of one of the firstly deflected drops or the nominal drops in a direction perpendicular to the nominal flight plane without causing a substantial deflection of drops following the other of the first deflection flight paths or the nominal flight paths. Secondly deflected drops are captured before they impinge a receiver medium. An image pattern is thereby deposited by either firstly deflected or undeflected drops.

21 Claims, 18 Drawing Sheets

DEFLECTED DROP LIQUID PATTERN DEPOSITION APPARATUS AND METHODS

FIELD OF THE INVENTION

This invention relates generally to the field of digitally controlled printing and liquid patterning devices, and in particular to continuous ink jet systems in which a liquid stream breaks into drops, some of which are selectively deflected.

BACKGROUND OF THE INVENTION

Traditionally, digitally controlled liquid patterning capability is accomplished by one of two technologies. In each technology, a patterning liquid is fed through channels formed in a printhead. Each channel includes a nozzle from which drops of liquid are selectively extruded and deposited upon a medium. When color marking is desired, each technology typically requires independent liquid supplies and separate liquid delivery systems for each liquid color used during printing.

The first technology, commonly referred to as "drop-on-demand" ink jet printing, provides liquid drops for impact upon a recording surface using a pressurization actuator (thermal, piezoelectric, etc.). Selective activation of the actuator causes the formation and ejection of a flying drop that crosses the space between the printhead and the pattern receiving media, striking the media. The formation of printed images or other patterns is achieved by controlling the individual formation of liquid drops, based on data that specifies the pattern or image.

Conventional "drop-on-demand" ink jet printers utilize a pressurization actuator to produce the ink jet drop at orifices of a print head. Typically, the pressurization is accomplished by rapidly displacing a portion of the liquid in individual chambers that supply individual nozzles. Displacement actuators are most commonly based on piezoelectric transducers or vapor bubble forming heaters (thermal ink jet). However, thermomechanical and electrostatic membrane displacement has also been disclosed and used.

U.S. Pat. No. 4,914,522 issued to Duffield et al., on Apr. 3, 1990 discloses a drop-on-demand ink jet printer that utilizes air pressure to produce a desired color density in a printed image. Liquid in a reservoir travels through a conduit and forms a meniscus at an end of an inkjet nozzle. An air nozzle, positioned so that a stream of air flows across the meniscus at the end of the liquid nozzle, causes the liquid to be extracted from the nozzle and atomized into a fine spray. The stream of air is applied at a constant pressure through a conduit to a control valve. The valve is opened and closed by the action of a piezoelectric actuator. When a voltage is applied to the valve, the valve opens to permit air to flow through the air nozzle. When the voltage is removed, the valve closes and no air flows through the air nozzle. As such, the liquid dot size on the image remains constant while the desired color density of the liquid dot is varied depending on the pulse width of the air stream.

The second technology, commonly referred to as "continuous stream" or "continuous" ink jet printing (CIJ), uses a pressurized liquid source which produces a continuous stream of liquid drops. This technology is applicable to any liquid patterning or selection application. Conventional continuous ink jet printers utilize electrostatic charging devices that are placed close to the point where a filament of working fluid breaks into individual drops. The drops are electrically charged and then deflected to an appropriate location by an electric field of self-image charge in a grounded conductor. When no drop deposition is desired at a particular location on the receiver medium, the drops are deflected into an liquid capturing mechanism, a drop catcher or gutter, and either recycled or discarded. When a print or pattern drop is desired, the drops are not deflected to the drop catcher and are allowed to strike the receiver media. Alternatively, deflected drops may be allowed to strike the media, while non-deflected drops are collected in the liquid capturing mechanism.

Conventional continuous ink jet printers utilize electrostatic charging devices and deflector plates that require addressable electrical components that must be very closely and precisely aligned to the continuous streams of patterning liquid without touching them. The patterning liquid, the liquid, must be sufficiently conductive to allow drop charging within a few microseconds. While serviceable, these electrostatic deflection printheads are difficult to manufacture at low cost and suffer many reliability problems do to shorting and fouling of the drop charging electrodes and deflection electric field plates. A continuous ink jet system that does not rely on drop charging would greatly simplify printhead manufacturing, and eliminate the need for highly conductive working fluids.

U.S. Pat. No. 3,709,432, issued to Robertson, on Jan. 9, 1973, discloses a method and apparatus for stimulating a filament of working fluid causing the working fluid to break up into uniformly spaced liquid drops through the use of transducers. The lengths of the filaments before they break up into liquid drops are regulated by controlling the stimulation energy supplied to the transducers, with high amplitude stimulation resulting in short filaments and low amplitudes resulting in long filaments. A flow of air is generated uniformly across all the paths of the fluid at a point intermediate to the ends of the long and short filaments. The air flow affects the trajectories of the filaments before they break up into drops more than it affects the trajectories of the liquid drops themselves. By controlling the lengths of the filaments, the trajectories of the liquid drops can be controlled, or switched from one path to another. As such, some liquid drops may be directed into a catcher while allowing other liquid drops to be applied to a receiving member. The physical separation or amount of discrimination between the two drop paths is very small and difficult to control.

U.S. Pat. No. 4,190,844, issued to Taylor, on Feb. 26, 1980, discloses a single jet continuous ink jet printer having a first pneumatic deflector for deflecting non-printing drops to a catcher and a second pneumatic deflector for oscillating printing drops (Taylor '844 hereinafter). A printhead supplies a filament of working fluid that breaks into individual liquid drops. The liquid drops are then selectively deflected by a first pneumatic deflector, a second pneumatic deflector, or both. The first pneumatic deflector has a diaphragm that either opens or closes a nozzle depending on one of two distinct electrical signals received from a central control unit. This determines whether the liquid drop is to be deposited on the medium or not. The second pneumatic deflector is a continuous type having a diaphragm that varies the amount a nozzle is open depending on a varying electrical signal received the central control unit. This deflects printed liquid drops vertically so that characters may be printed one character at a time. If only the first pneumatic deflector is used, characters are created one line at a time, being built up by repeated traverses of the printhead.

While this method does not rely on electrostatic means to affect the trajectory of drops it does rely on the precise control and timing of the first ("open/closed") pneumatic deflector to create printed and non-printed liquid drops. Such a system is difficult to manufacture and accurately control. The physical separation or amount of discrimination between the two drop paths is erratic due to the uncertainty in the increase and decrease of air flow during switching resulting in poor drop trajectory control and imprecise drop placement. Pneumatic operation requiring the air flows to be turned on and off is necessarily slow in that an inordinate amount of time is needed to perform the mechanical actuation as well as time associated with the settling any transients in the air flow. Further, it would be costly to manufacture a closely spaced array of uniform first pneumatic deflectors necessary to extend the Taylor '844 concept to a plurality of closely spaced jets.

U.S. Pat. No. 5,963,235 issued to Chwalek, et al., on Oct. 5, 1999 discloses a continuous ink jet printer that uses a micromechanical actuator that impinges a curved control surface against the continuous stream filaments prior to break-up into droplets (Chawlek '235 hereinafter). By manipulating the amount of impingement of the control surface the stream may be deflected, along multiple flight paths. While workable, this apparatus tends to produce large anomalous swings in the amount of stream deflection as the surface properties are affected by contact with the working fluid.

U.S. Pat. No. 6,509,917 issued to Chwalek et al., on Jan. 21, 2003, discloses a continuous ink jet printer that uses electrodes located downstream of the nozzle, closely spaced to the unbroken fluid column, to deflect the continuous stream filament before breaking into drops (Chawlek '917 hereinafter). By imposing a voltage on the electrodes drops may be steered along different deflection paths. This approach is workable however the apparatus prone to electrical breakdown due to a build up-of conductive debris around the deflection electrodes.

U.S. Pat. No. 6,474,795 issued to Lebens, et al., on Nov. 5, 2002 discloses a continuous ink jet printer that uses a dual passage way to supply fluid to each nozzle (Lebens '795 hereinafter). One fluid passageway is located off-center to the nozzle entry bore and has a micromechanical valve that regulates the amount of flow that is supplied. The off-center flow from this passageway causes the jet to be emitted at an angle. Thus by manipulating this valve, drops may be directed to different deflection pathways. This approach is workable however the printhead structure is more complex to fabricate and it is difficult to achieve uniform deflection from all of the jets in a large array of jets.

U.S. Pat. No. 6,079,821, issued to Chwalek et al., on Jun. 27, 2000, discloses a continuous ink jet printer that uses actuation of asymmetric heaters to create individual liquid drops from a filament of working fluid and deflect those liquid drops (Chwalek '821 hereinafter). A printhead includes a pressurized liquid source and an asymmetric heater operable to form printed liquid drops and non-printed liquid drops. Printed liquid drops flow along a printed liquid drop path ultimately striking a print media, while non-printed liquid drops flow along a non-printed liquid drop path ultimately striking a catcher surface. Non-printed liquid drops are recycled or disposed of through a liquid removal channel formed in the catcher.

While the ink jet printer disclosed in Chwalek '821 works extremely well for its intended purpose, the amount of physical separation between printed and non-printed liquid drops is limited which may limit the robustness of such a system. Simply increasing the amount of asymmetric heating to increase this separation will result in higher temperatures that may decrease reliability.

U.S. Pat. No. 6,505,921 issued to Chwalek, et al. on Jan. 14, 2003, discloses and claims an improvement over Chwalek '821 whereby a plurality of thermally deflected liquid streams is caused to break up into drops of large and small volumes, hence, large and small cross-sectional areas (Chwalek '921 hereinafter). Thermal deflection is used to cause smaller drops to be directed out of the plane of the plurality of streams of drops while large drops are allowed to fly along nominal "straight" pathways. A uniform gas flow is imposed in a direction perpendicular and across the array of streams of drops of cross-sectional areas. This perpendicular gas flow applies more force per mass to drops having smaller cross-sections than to drops having larger cross-sections, resulting in an amplification of the deflection acceleration of the small drops. Such gas flow deflection amplification can provide needed additional separation between drops to be captured in a gutter versus drops that are allowed to deposit on a medium. However, to be effective, the apparatus of Chwalek '921 requires a substantial difference in large and small drop volumes which has the effect reducing printing speed as time and liquid volume is spent creating large drops.

U.S. Pat. No. 6,508,542 issued to Sharma, et al. on Jan. 21, 2003, also discloses and claims an improvement over Chwalek '821 that uses a gas flow to amplify the spatial separation between drops traveling along two diverging pathways, so as to improve the reliability of drop capture (Sharma '542 hereinafter). Sharma '542 teaches a gas flow that is emitted in close proximity to a gutter drop capture lip and that is generally opposed to both the nominal and thermally deflected flight paths of drops. The gas flow of Sharma '542 is illustrated as further splitting the drops into two pathways and is positioned so that the gas flow is losing convergence at a point where the thermally deflected drops are physically separating.

Effectively, the apparatus and method taught by Sharma '542 increases drop pathway divergence by reducing the drop velocity in the direction of the media and gutter. That is, by slowing the flying drops, more time is provided for the off-axis thermal deflection acceleration imparted at the nozzle to build up into more spatial divergence by the time the capture lip of the gutter is reached. The interaction of the gas flow of Sharma '524, and the diverging drop pathways, will also be very dependent on the time varying pattern of drops inherent in image or other pattern printing. Different drop sequences with be differently deflected, resulting in the addition of data dependent drop placement error for the printed drops. Further, the approach of Sharma '542 may be unsuitable to implement for a large array of jets as it is difficult to achieve sufficiently uniform gas flow behavior along a wide slit source so that the point of transition to incoherent gas flow would occur at the same distance from the nozzle for all jets of the array.

Notwithstanding the several inventions described above, there remains a need for a robust, high speed, high quality liquid patterning system. Such a system may be realized using continuous ink jet technology that does not rely on drop charging and electrostatic drop deflection. Further, such a system could be realized if sufficient drop deflection can be achieved to allow robust drop capturing without sacrificing print speed and pattern resolution by the formation of large volume drops or long flight paths from nozzle to medium. Finally, such a system requires simplicity of design that facilitates fabrication of large arrays of closely space jets.

SUMMARY OF THE INVENTION

The foregoing and numerous other features, objects and advantages of the present invention will become readily apparent upon a review of the detailed description, claims and drawings set forth herein. These features, objects and advantages are accomplished by constructing a drop deflector apparatus for a continuous drop emission system comprising a plurality of drop nozzles emitting a plurality of continuous streams of a liquid that breaks up into streams of drops of substantially uniform drop volume having nominal flight paths that are substantially parallel and substantially within a nominal flight plane. A plurality of path selection elements is provided corresponding to the plurality of continuous streams of drops operable to firstly deflect individual drops from the corresponding continuous stream of drops along a first deflection flight path diverging from the nominal flight path. Further, a plurality of gas nozzles is provided which generate a plurality of localized gas flows, positioned along one of the first deflection flight paths or the nominal flight paths, wherein the localized gas flows are oriented so as to cause a substantial second deflection of one of the firstly deflected drops or the nominal drops in a direction perpendicular to the nominal flight plane without causing a substantial deflection of drops following the other of the first deflection flight paths or the nominal flight paths.

The present inventions are also configured to have a gas nozzles associated with each drop emission nozzle or, alternatively, a gas nozzle shared with two adjacent drop emission nozzles.

The present inventions are additionally configured to use path selection elements comprising at least one of a heater apparatus that non-uniformly heats the corresponding continuous stream of liquid, an electrostatic force apparatus that attracts the corresponding continuous stream of liquid in the direction of the first deflection flight path, a moveable surface in contact with the corresponding continuous stream of liquid that is moveable in the direction of the first deflection flight path or a flow valve in a fluid path leading to the corresponding continuous stream of liquid wherein the flow valve is operable to cause an asymmetric flow through the corresponding one of the plurality of drop nozzles.

The present inventions further include methods of forming a liquid pattern on a medium based on pattern data comprising providing a plurality of drop nozzles emitting a plurality of continuous streams of drops of substantially uniform drop volume having nominal flight paths that are substantially parallel, substantially within a nominal flight plane and that impinge the medium. Further forming the liquid pattern by firstly deflecting individual drops from the plurality of continuous streams of drops, based on pattern data, along first deflection flight paths that diverge from the nominal flight path while remaining substantially within the nominal flight plane and then secondly deflecting drops traveling along one of the first deflection flight paths or the nominal flight paths in a direction perpendicular to the nominal flight plane by a plurality of localized gas flows without causing a substantial deflection of drops following the other of the first deflection flight paths or the nominal flight paths. The secondly deflected drops are captured in a drop catcher thereby forming the liquid pattern on the media comprised of drops that are not secondly deflected.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. Functional elements and features have been given the same numerical labels in the figures if they are the same element or perform the same function for purposes of understanding the present inventions. It is to be understood that elements not specifically shown or described may take various forms well known to those skilled in the art.

Figure 1:
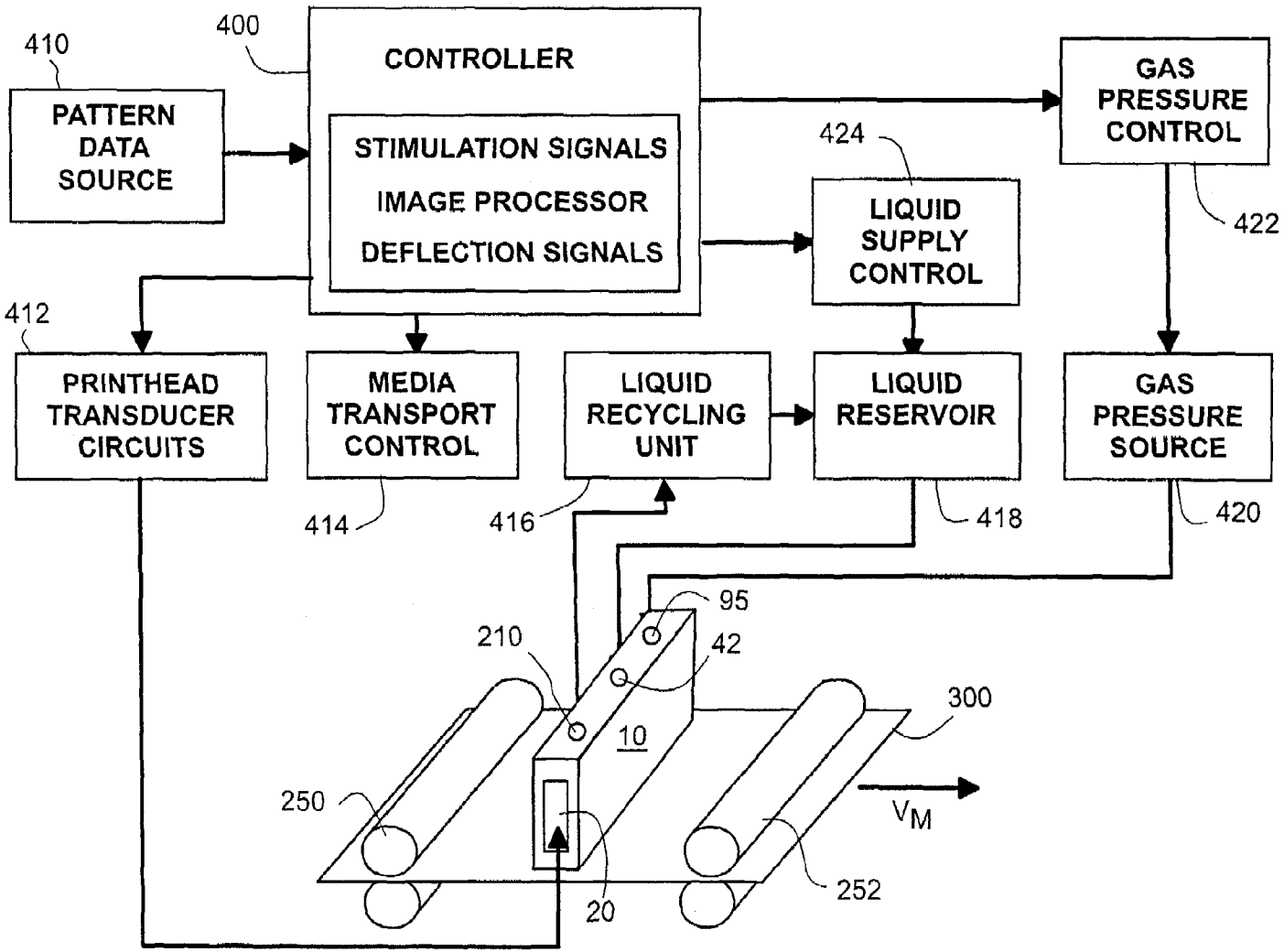
FIG. 1 shows a simplified block schematic diagram of one exemplary liquid pattern deposition apparatus made in accordance with the present invention.

Referring to FIG. 1, a continuous drop emission system for depositing a liquid pattern is illustrated. Typically such systems are ink jet printers and the liquid pattern is an image printed on a receiver sheet or web. However, other liquid patterns may be deposited by the system illustrated including, for example, masking and chemical initiator layers for manufacturing processes. For the purposes of understanding the present inventions the terms "liquid" and "ink" will be used interchangeably, recognizing that inks are typically associated with image printing, a subset of the potential applications of the present inventions. The liquid pattern deposition system is controlled by a processor 400 that interfaces with various input and output components, computes necessary translations of data and executes needed programs and algorithms.

The liquid pattern deposition system further includes a source of the image or pattern data 410 which provides raster image data, outline image data in the form of a page description language, or other forms of digital image data. This image data is converted to bitmap image data by controller 400 and stored for transfer to a multi-jet drop emission printhead 10 via a plurality of printhead transducer circuits 412 connected to printhead electrical interface 20. The bit map image data specifies the deposition of individual drops onto the picture elements (pixels) of a two dimensional matrix of positions, equally spaced a pattern raster distance, determined by the desired pattern resolution, i.e. the pattern "dots per inch" or the like. The raster distance or spacing may be equal or may be different in the two dimensions of the pattern.

Controller 400 also creates drop synchronization signals to the printhead transducer circuits that are subsequently applied to printhead 10 to cause the break-up of the plurality of fluid streams emitted into drops of substantially the same size and with a predictable timing. Printhead 10 is illustrated as a "page wide" printhead in that it contains a plurality of jets sufficient to print all scanlines across the medium 300 without need for movement of the printhead itself.

Recording medium 300 is moved relative to printhead 10 by a recording medium transport system 250, which is electronically controlled by a media transport control system 414, and which in turn is controlled by controller 400. The recording medium transport system shown in FIG. 1 is a schematic only, and many different mechanical configurations are possible. For example, a transfer roller could be used as recording medium transport system 250 to facilitate transfer of the liquid drops to recording medium 300. Such transfer roller technology is well known in the art. In the case of page width printheads as illustrated in FIG. 1, it is most convenient to move recording medium 300 past a stationary printhead. However, in the case of scanning print systems, it is usually most convenient to move the printhead along one axis (the sub-scanning direction) and the recording medium along an orthogonal axis (the main scanning direction) in a relative raster motion.

Pattern liquid is contained in a liquid reservoir 418 under pressure. In the non-printing state, continuous drop streams are unable to reach recording medium 300 due to a fluid gutter (not shown) that captures the stream and which may allow a portion of the liquid to be recycled by a liquid recycling unit 416. The liquid recycling unit 416 reconditions the liquid and feeds it back to reservoir 418 via printhead fluid outlet 210. The liquid recycling unit may also be configured to apply a vacuum pressure to outlet 210 to assist in liquid recovery and control of the gas flow through printhead 10. Such liquid recycling units are well known in the art. The liquid pressure suitable for optimal operation will depend on a number of factors, including geometry and thermal properties of the nozzles and thermal properties of the liquid. A constant liquid pressure can be achieved by applying pressure to liquid reservoir 418 under the control of liquid supply controller 424 that is managed by controller 400.

The liquid is distributed via a liquid supply line entering printhead 10 at liquid inlet port 42. The liquid preferably flows through slots and/or holes etched through a silicon substrate of printhead 10 to its front surface, where a plurality of nozzles and printhead transducers are situated. In some preferred embodiments of the present inventions the printhead transducers are resistive heaters. In other embodiments, more than one transducer per jet may be provided including some combination of resistive heaters, electric field electrodes and microelectromechanical flow valves. With printhead 10 fabricated from silicon, it is possible to integrate some portion of the printhead transducer control circuits 412 with the printhead.

A secondary drop deflection apparatus, described in more detail below, is configured downstream of the liquid drop emission nozzles. This secondary drop deflection apparatus comprises a plurality of localized gas flows that impinge individual drops in the plurality of streams of drops flying along predetermined paths based on pattern data. A supply of pressurized gas 420, controlled by the controller 400 through a gas pressure control apparatus 422, is connected to printhead 10 via gas supply inlet 95.

Figure 2:
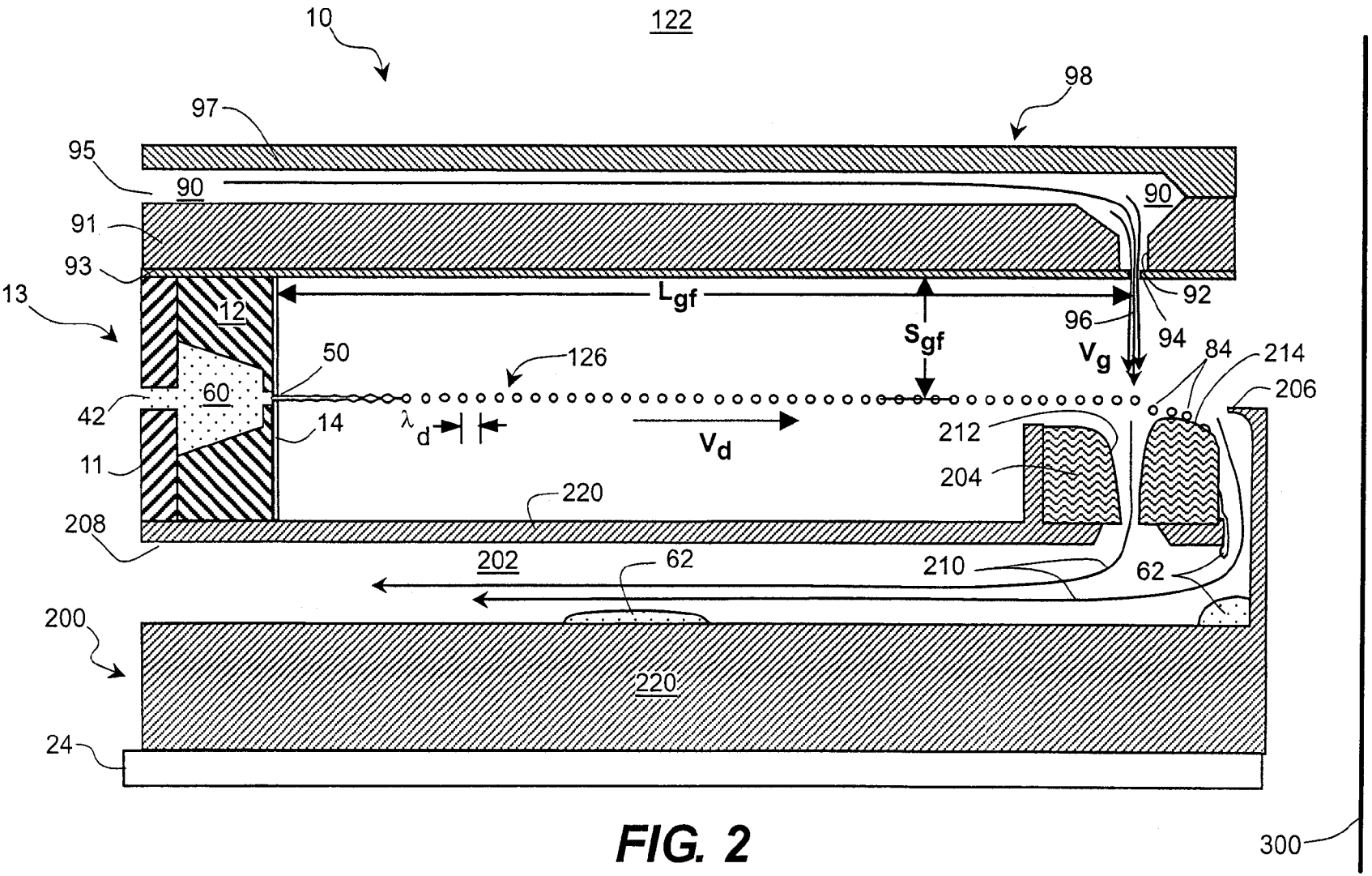
FIG. 2 shows a schematic cross section of a preferred embodiment of the present invention.

FIG. 2 is a side cross-sectional view of a liquid drop emission printhead 10 through one jet of the plurality of jets that form continuous drop streams 126. Printhead 10 is comprised of three major sub-system apparatus: a drop generator 13, a gas deflector apparatus 98 and a fluid capture apparatus 200. These printhead subsystem components are assembled to a printhead mounting plate 24. A single jet forming a stream of drops 126 is illustrated from among a plurality of jets that are emitted by drop generator 13. The jet illustrated is emitted from a nozzle 50 formed in a nozzle layer 14 on substrate 12 of drop generator 13. Pressurized liquid 60 is admitted to the printhead through drop generator back plate 11 via pressurized liquid inlet 42. The continuous stream of liquid is synchronized by thermal stimulation (not shown) to break-up into drops of substantially uniform volume traveling substantially perpendicular to the nozzle layer 14 and towards medium 300. The stream of drops 126 is being deflected by a localized gas flow 96 to the fluid capture apparatus (gutter) 200.

Localized gas flows 96 are produced by gas deflector apparatus 98 which is formed of a gas distribution manifold 91 with a gas flow nozzle layer 93 and gas distribution manifold cover 97. Pressurized gas 90 is supplied from an external source via pressurized gas inlet 95. The pressurized gas 90 flows through a distribution system to a gas flow separation passageway 92 that ends in a gas flow nozzle 94. The gas flow emitted by gas flow nozzle 94 is a highly localized gas jet 96 that is arranged to forcefully impinge individual drops 84 in stream 122 that fly through it, deflecting them to the fluid capture apparatus 200. The localized gas flow may be visualized as a truncated cone shaped flow of high velocity gas having an initial cross sectional area equal to that of gas flow nozzle 94 and diverging in a Gaussian distribution of velocity with distance away from gas nozzle layer 93. The cross-sectional area of the cone of localized gas flow is characterized as the aerial extent, or diameter $D_{gf}$, from the center of the flow out to the first standard deviation of gas flow velocity, $V_g$.

Gas flow nozzles 94 are spaced away from the path of the stream of drops 122 by a distance $S_{gf}$ that is chosen to be small enough that the diameter of localized gas flow 96, $D_{gf}$, has not diverged to an extent large enough to substantially impinge more than one drop in drop stream 122 at a time. Several factors are involved in the selection of separation distance, $S_{gf}$, including the area or effective diameter, $D_{gn}$, of gas nozzle 94, the pressure of the supplied gas 90, the diameter of the drops, $D_d$, the spacing or wavelength, $\lambda_d$, of drops in the synchronized stream of drops and the spacing $S_{dn}$ of drop nozzles, hence drop streams, along the array of drop streams in printhead 10. As a general rule, the diameter of the gas flow, $D_{gf}$, at separation distance $S_{gf}$ should not exceed the drop diameter $D_d$. The array of gas flow nozzles 94 is positioned downstream from the drop generator nozzle layer 14 an appropriate distance $L_g$, to be explained further hereinbelow.

The pressurized gas source 420 for the gas deflector apparatus 98 can be of any type and may include any number of appropriate plenums, conduits, blowers, fans, etc. Gas distribution manifold 91 may be any appropriate shape. The nature of the gas used may be any that is economically available and is safe and effective for the liquid pattern application system involved, for example air, nitrogen, argon, and the like.

Fluid capture apparatus 200 is comprised of a fluid capture manifold 220 having a captured fluid return passage 202 and formed with a drop capture or gutter lip 206. Gutter lip 206 defines the cleavage point between drops that are captured and drops that are permitted to fly to medium 300. Drops must be sufficiently deflected by localized gas flows 96 to travel downward in the illustration, below gutter lip 206. Fluid capture apparatus 200 is illustrated with a porous media component 204 that serves as a landing surface 214 for drops 84 deflected by localized gas flows 96. It is desirable that gas deflected drops impinge the porous landing surface rather than impact gutter lip 206 to minimize the production of liquid mist.

Porous media component 204 may also be formed with a slot 212 that is opposite the location of gas flow nozzles 94, that is, located at a distance $L_{gf}$ downstream of drop generator nozzle layer 14. A vacuum or negative pressure source is applied to the fluid capture manifold by the liquid recycling unit 416 via fluid capture outlet 208. A flow of captured gas and liquid 62 is established as indicated by flow lines 210. Captured fluid 62 is separated from captured gasses by the liquid recycling unit 416 for possible re-introduction into the liquid reservoir. The fluid capture apparatus captures both the localized gas flows produced by gas deflector 98 as well as drawing in ambient gases entrained by the deflected drops 84.

Figure 3:
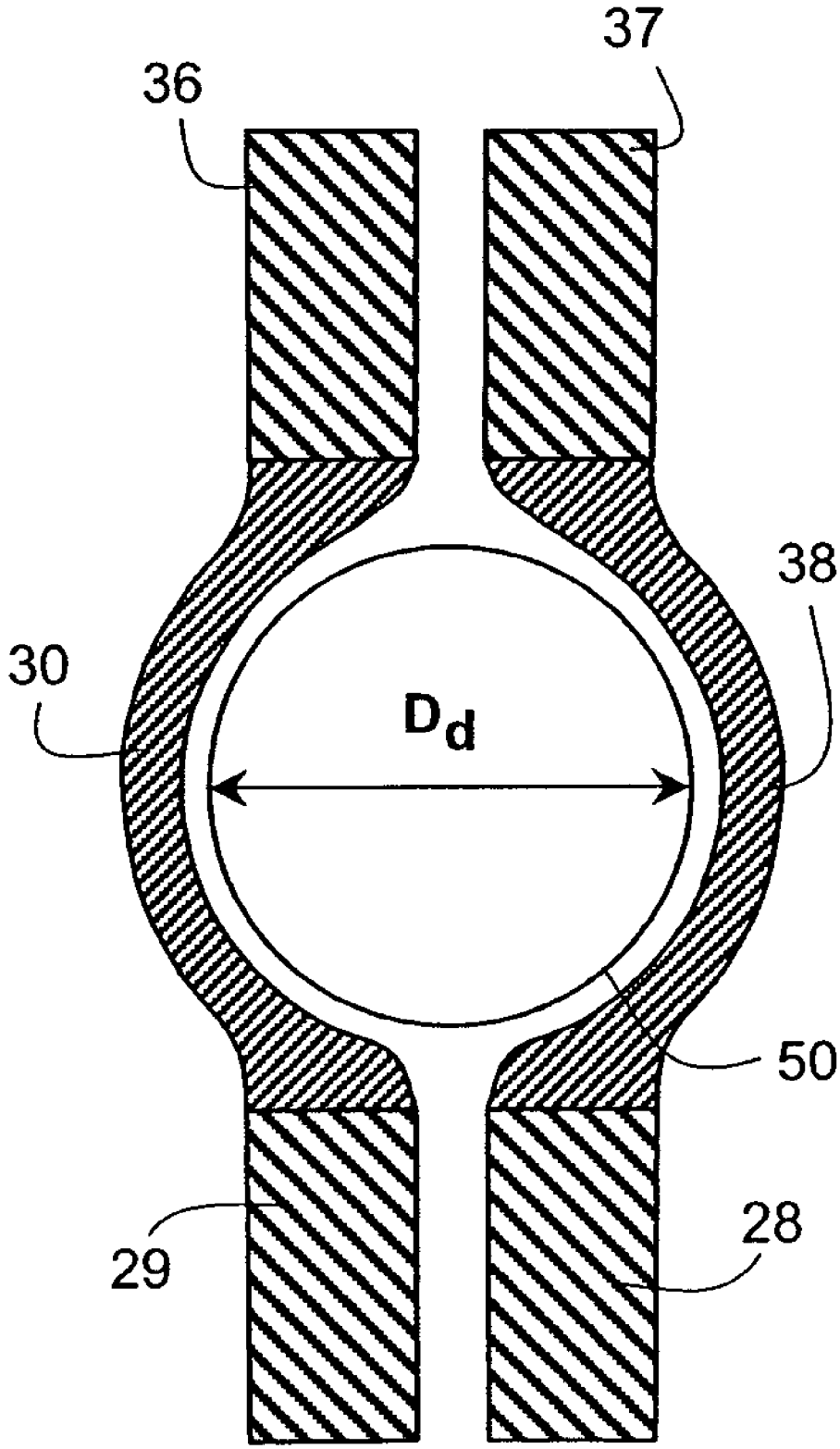
FIG. 3 shows a schematic plane view of a first deflection apparatus for a single jet according to a preferred embodiment of the present invention.
Figure 4:
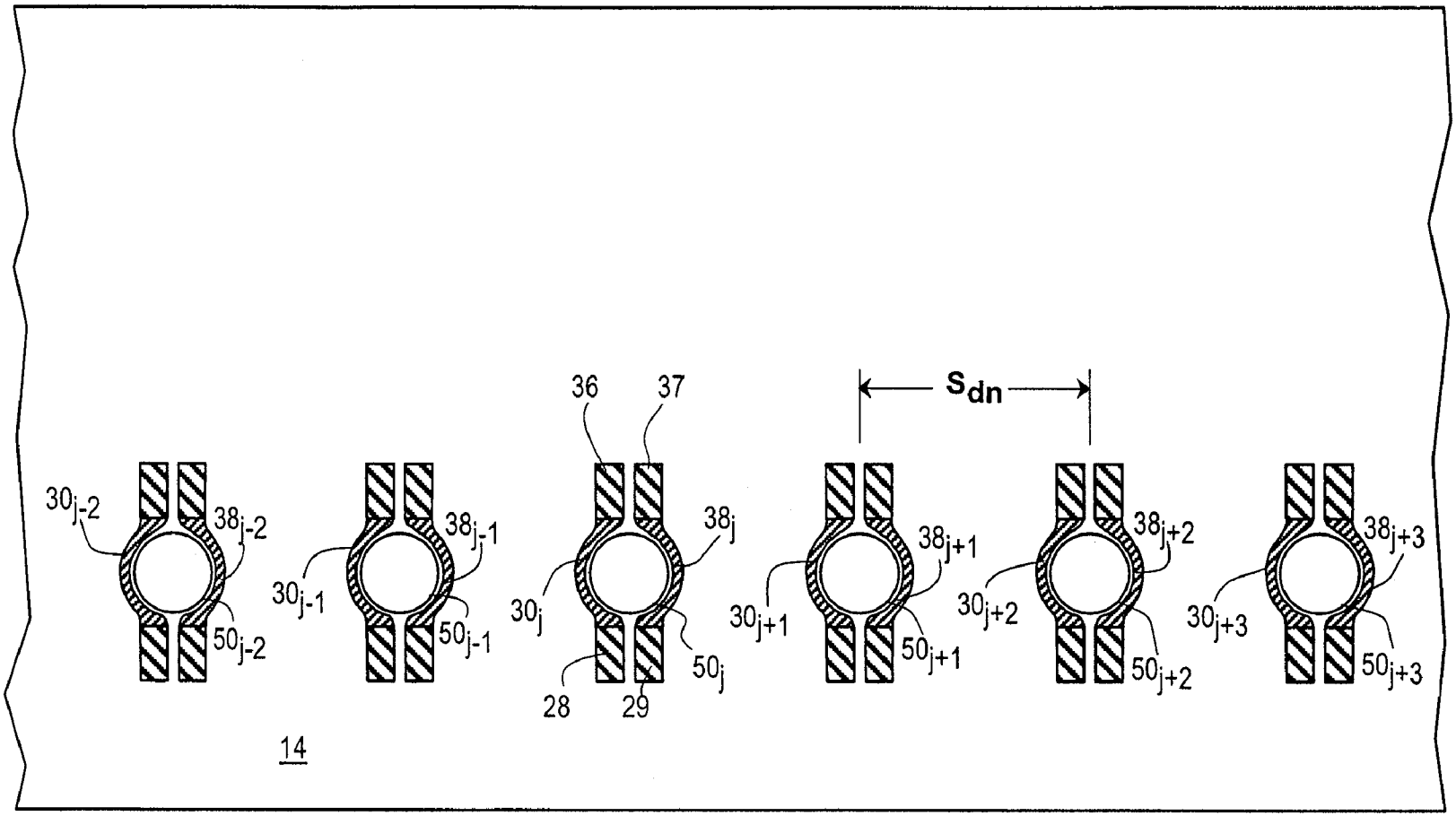
FIG. 4 shows a plane view of a first deflection apparatus for a portion of an array of jets according to a preferred embodiment of the present invention.

A front face view of a single nozzle 50 of a preferred printhead embodiment is illustrated in FIG. 3. A portion of an array of such nozzles is illustrated in FIG. 4. For simplicity of understanding, when multiple jets and component elements are illustrated, suffixes "j", "j+1", et cetera, are used to denote the same functional elements, in order, along a large array of such elements. FIGS. 3 and 4 show nozzles 50 of drop generator 13 having a circular shape with a diameter, $D_{dn}$, equally spaced a drop nozzle spacing, $S_{dn}$, along a nozzle array direction or axis. While a circular nozzle is depicted, other shapes for the liquid emission orifice may be used and an effective diameter expressed. Typically the nozzle diameter will be formed in the range of 8 microns to 35 microns, depending on the size of drops that are appropriate for the liquid pattern being deposited. Typically the drop nozzle spacing will be in the range 84 to 21 microns to correspond to a pattern raster resolution in the nozzle axis direction of from 300 pixels/inch to 1200 pixels/inch.

Two resistive heaters, side one heater 30, and side two heater 38, are formed on a front face layer on opposite sides of the nozzle bore, wherein the term "side" means along the direction of the array of nozzles as is seen in FIG. 4. The side heaters are separately addressed for each jet by address leads 36, 29 for side one and 37, 28 for side two. The two side heaters allow heat energy to be applied differentially to two sides of the emerging fluid stream in order to deflect a portion of the stream in the direction of one or the other heater, as disclosed in Chawlek '917. These same resistive heaters are also utilized to launch a surface wave of the proper wavelength to synchronize the jet of liquid to break-up into drops of substantially uniform diameter, $D_d$, and spacing $\lambda_d$.

The spacing away from the nozzle rim and the width of the side heaters along the direction of the array of nozzles are an important design parameters. Typically the inner edge of the side heater resistors is positioned approximately 1.5 microns to 0.5 microns away from the nozzle edge. The outer edge, hence width, of the side heater resistors is typically placed 1 micron to 3 microns from the inner edge of the side heater resistors.

Figure 5A:
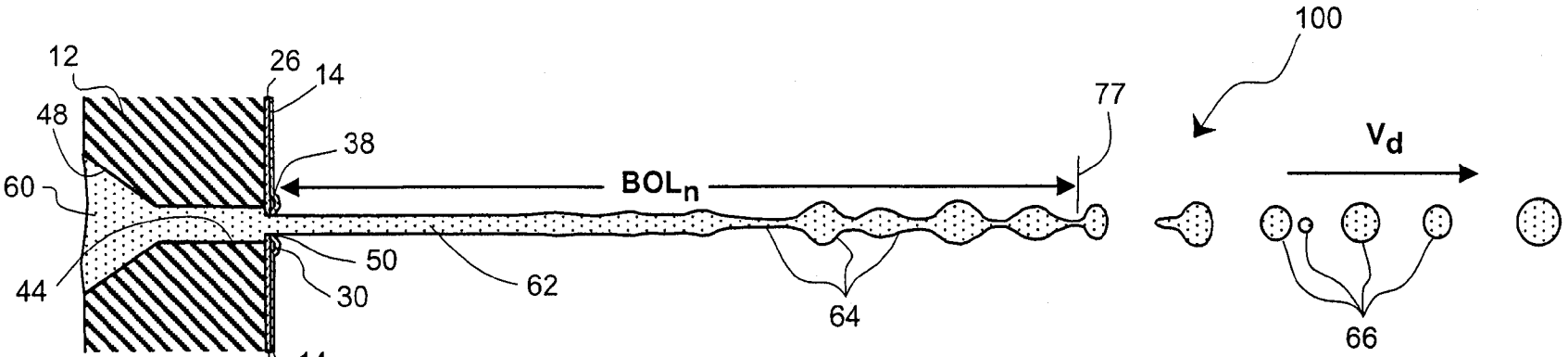
FIGS. 5(*a*) and 5(*b*) show schematic top views of a single continuous stream of fluid with and without the application of a synchronizing thermal energy perturbation according to a preferred embodiment of the present invention.
Figure 5B:
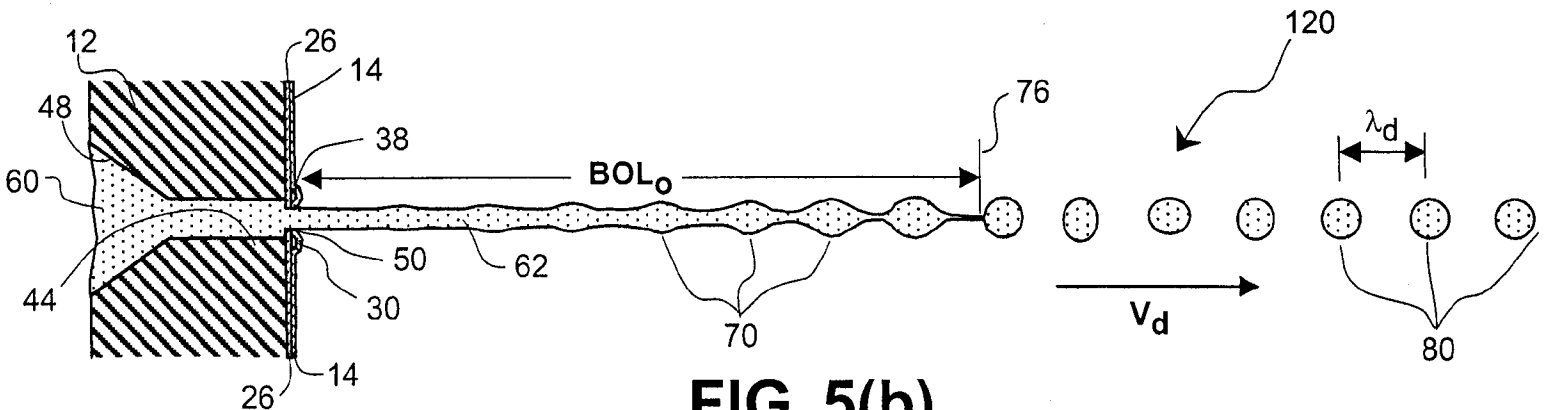

One effect of pulsing side heaters 30 and 38 on a continuous stream of fluid 62 is illustrated in a top side view in FIGS. 5(*a*) and 5(*b*). FIGS. 5(*a*) and 5(*b*) illustrates a portion of a drop generator substrate 12 around one nozzle 50 of the plurality of nozzles. Pressurized fluid 60 is supplied to nozzle 50 via liquid supply chamber 48 and flow separation passageway 44. Nozzle 50 is formed in drop nozzle front face layer 14, and possibly in thermal and electrical isolation layer 26. Side heater resistors 30 and 38 are also illustrated.

In FIG. 5(*a*) side heaters 30 and 38 are not energized. Continuous fluid stream 62 forms natural surface waves 64 of varying wavelengths resulting in an unsynchronized break-up at location 77 into a stream 100 of drops 66 of widely varying diameter and volume. The natural break-off length, $BOL_n$, is defined as the distance from the nozzle face to the point where drops detach from the continuous column of fluid. For this case of natural, unsynchronized break-up, the break-off length, $BOL_n$, is not well defined and varies considerably with time.

In FIG. 5(*b*) side heaters are pulsed with energy pulses sufficient to launch a dominant surface wave 70 on the fluid column 62, leading to the synchronization of break-up into a stream 120 of drops 80 of substantially uniform diameter, $D_d$, and spacing, $\lambda_d$, and at a stable operating break-off point 76 located an operating distance, $BOL_o$, from the nozzle plane. The fluid streams and individual drops 66 and 80 in FIGS. 5(*a*) and 5(*b*) travel along a nominal flight path at a velocity of $V_d$, based on the fluid pressurization magnitude, nozzle geometry and fluid properties.

Figure 6:
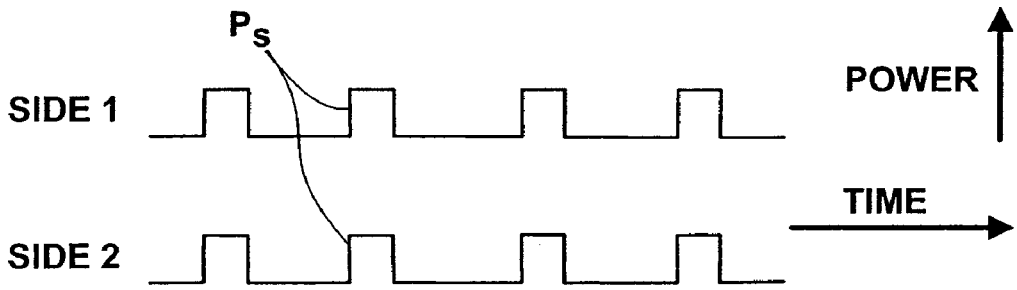
FIGS. 6(*a*), 6(*b*) and 6(*c*) show representations of energy pulse sequences for stimulating synchronous break-up of a fluid jet by heater resistors and first deflection by heater resistors according to a preferred embodiment of the present invention.
Figure 6:
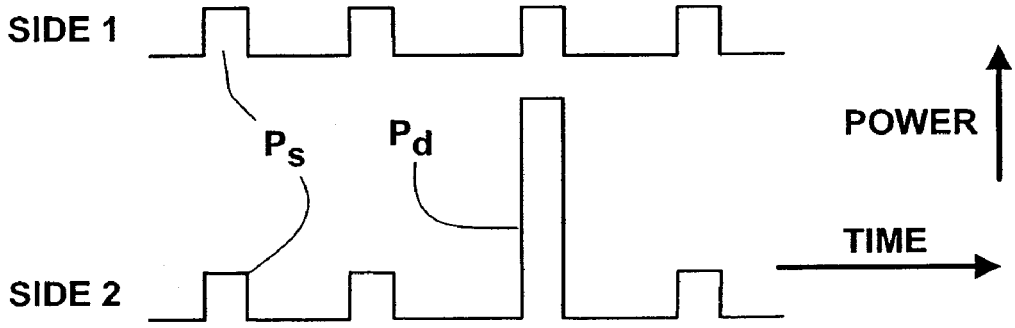
Figure 6:
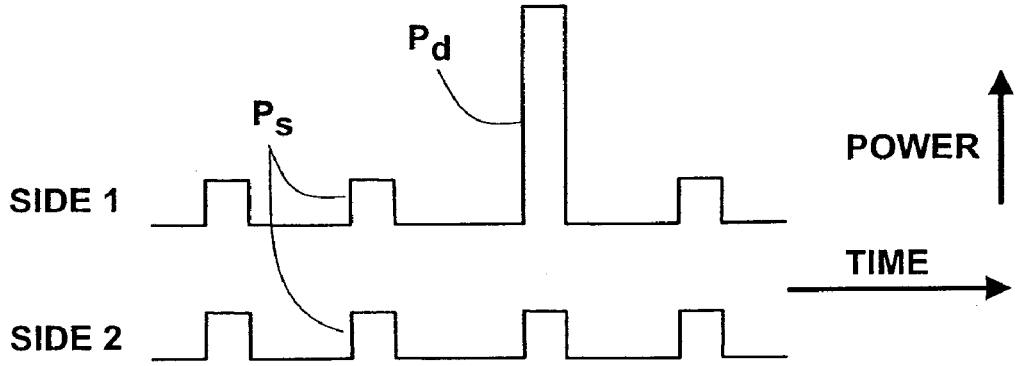

FIG. 6(*a*) illustrates power pulse sequences that may be applied to side one heater resistor 30 and side two heater resistor 38 to launch the dominant surface waves 70 depicted in FIG. 5(*b*). For this example, equal synchronization energy pulses, $P_s$, are applied to both side heaters. The frequency of these pulses results in a same frequency of drop break-up on the jet. It is not necessary to pulse both side heaters to achieve Rayleigh break-up of the stream. It is sufficient to apply pulses to only one side or to both sides in different amounts or even to both sides at different times as long as a desired dominant surface wave perturbation results. Thermal energy stimulation for synchronizing continuous jet break-up is well known and is explained in Chwalek '821.

Figure 8A:
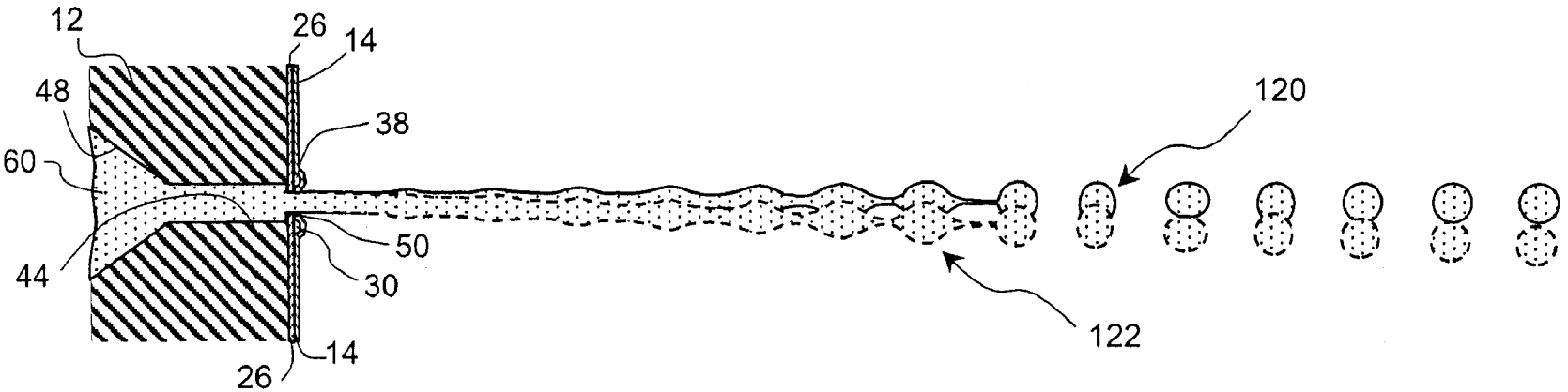
FIGS. 8(*a*) and 8(*b*) show schematic top views of a single continuous stream of drops being firstly deflected to one side then the other side by heater resistors according to a preferred embodiment of the present invention.
Figure 8B:
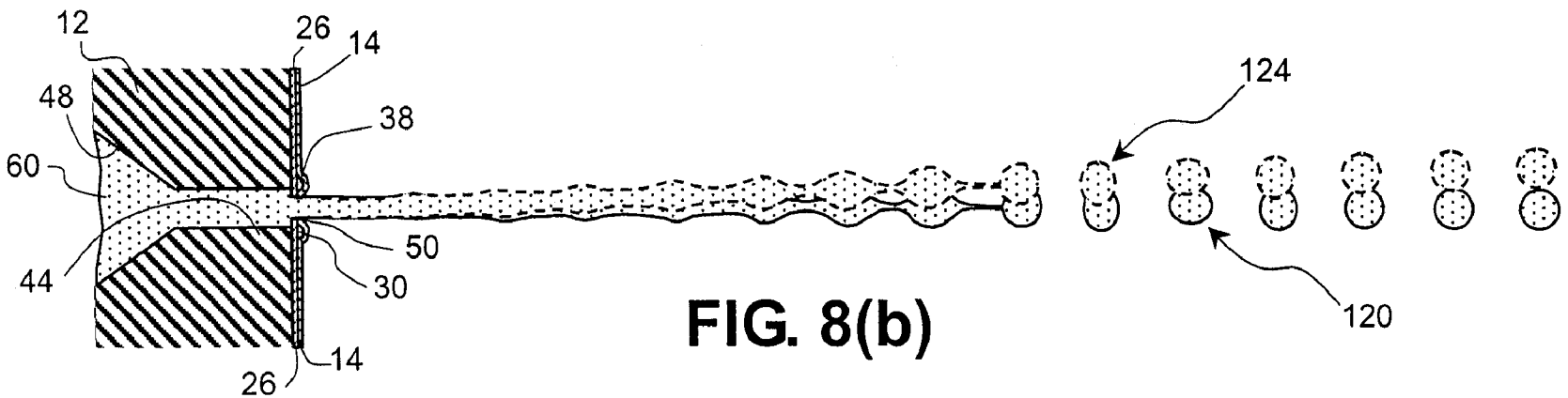

FIGS. 6(*b*) and 6(*c*) illustrate two pulse sequences that may be used to not only synchronize jet break-up but also to deflect a portion of the fluid in a sideward deflection. For example in FIG. 6(*b*), the energy pulses of magnitude $P_s$ are mostly applied to both side one 30 and side two 38 heaters except for one large pulse of energy $P_d$ applied to side two heater 38 during the third pulse time slot illustrated. The higher energy pulse applied to the side two heater resistor 38 heats the adjacent fluid to a higher temperature, causing it to travel faster through side two of the nozzle. This asymmetric velocity, in turn causes a portion of the fluid to be deflected away from the heated side. FIG. 8(*a*) illustrates the deflected portion of fluid by showing a primary fluid column and stream of drops 120 and, drawn in phantom lines, a secondary, deflected stream of drops 122.

Alternatively, FIG. 6(*c*) shows a similar pulse sequence to that of FIG. 6(*b*) except that the side one heater resistor 30 receives a large energy pulse, $P_d$, during the third pulse time slot. FIG. 8(*b*) illustrates via phantom lines a secondary stream of drops 124 deflected from the nominal drop stream 120 to a position away from the side one heater resistor 30. The application of asymmetric thermal pulses does not always result in the stream deflecting away from the net hottest side resistor. If the side resistors are narrow, the hot side resistor may result in the detachment of the liquid meniscus from the hot side of the nozzle, causing the fluid stream to deflect, instead, towards the hotter side heater resistor. The phenomenon of thermal deflection of continuous jet streams is explained in Chwalek '821.

Figures 7A, 7B, 7C:
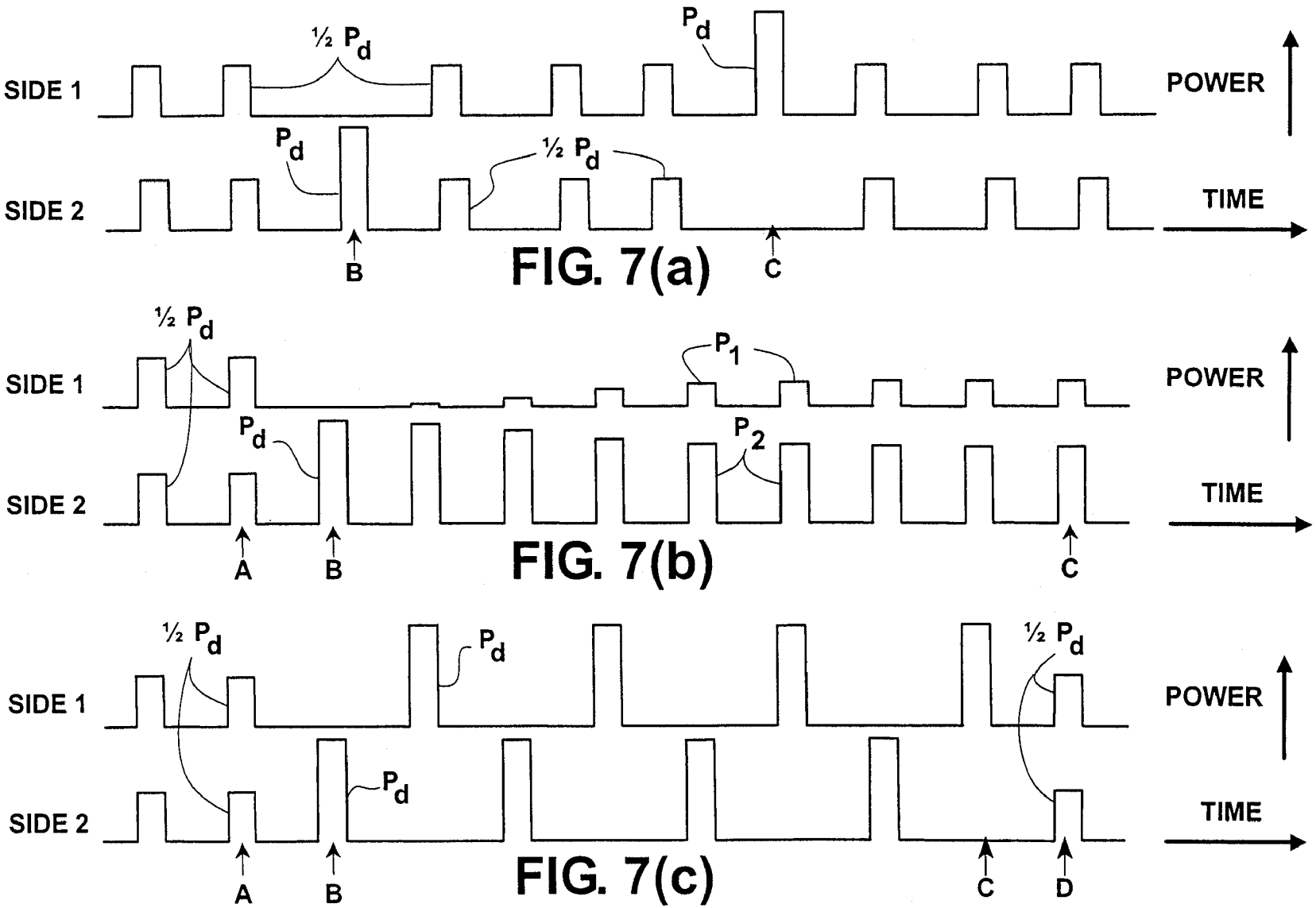
FIGS. 7(*a*), 7(*b*) and 7(*c*) show representations of balanced energy pulse sequences for stimulating synchronous break-up of a fluid jet by heater resistors and first deflection by heater resistors according to a preferred embodiment of the present invention.

FIGS. 7(*a*), 7(*b*) and 7(*c*) show representations of balanced energy pulse sequences for stimulating synchronous break-up of a fluid jet by heater resistors and first deflection by heater resistors according to additional preferred embodiments of the present inventions. The energy pulses applied to the side one 30 and side two 38 heaters are adjusted so that the same amount of energy in total is applied to the heaters during each drop synchronization period. Balancing the energy pulses in this manner ensures that a relatively constant average power is applied to the heaters adjacent each jet, so that a relatively constant amount of waste heat is dissipated by thermal management pathways that are provided for each jet.

FIG. 7(*a*) illustrates two pulse sequences that employ a pulse of magnitude $P_d$ to one heater while the other receives zero power when a drop is to be deflected, for example at time period B and time period C as indicated. If drops are not to be firstly deflected, power pulses equal to one-half $P_d$ are applied to both heaters. The pulse sequences in FIG. 7(*a*) also illustrate a printing method in which drops from a same stream are deflected both to side one and to side two as illustrated in FIGS. 8(*a*) and 8(*b*). For some embodiments of the present inventions, drops are deflected towards localized gas flows located to either side of the nominal flight path of the drop stream.

FIG. 7(*b*) illustrates two pulse sequences that employ balanced energy pulses $P_1$ and $P_2$ applied to side one 30 and side two 38 heaters respectively. In this embodiment the total pulse energy is set equal to $P_d$; $P_1+P_2=P_d$. For long sequences of deflected drops, the pulse energies are adjusted so that all of the heating does not occur on one side. For example, in FIG. 7(*b*) no deflection is caused for the drop associated with time period A and $P_1=P_2=½ P_d$. The eight drops associated with the time periods beginning with time period B through time period C are deflected away from side two heater 38. Side two heater 38 receives a pulse of energy $P_d$ at time period B while side one heater 30 receives zero energy. For the subsequent sequentially deflected seven drops up to time period C, the pulse energy applied to side two heater 38 is decreased while the energy applied to side one heater 30 is increased. In the illustrated example, the pulse energy applied to the heaters at time period C is $P_1=0.75 P_d$, $P_2=0.25 P_d$. Shifting the power balance may be made data-dependent by keeping track of the sequence of deflected and undeflected drops for each jet. Power shifting is useful to assist in heat dissipation by utilizing the thermal pathways on both sides of a jet. A stream of deflected drops will somewhat drag trailing drops along so that not as much initial first deflection is needed for the trailing drops in a sequence of deflected drops.

FIG. 7(*c*) illustrates two pulse sequences that employ balanced energy pulses applied to side one 30 and side two 38 heaters respectively, except balance is maintained by alternately deflecting drops to both sides of a jet. That is, deflection pulse energies to the two side heaters are maintained at $P_d$ and 0; and spatial thermal balance is maintained by alternating these energies between side heaters. The pulsing approach illustrated in FIG. 7(*c*) is useful for embodiments of the present inventions in which drops are deflected towards localized gas flows located to either side of the nominal flight path of the drop stream. For embodiments wherein the firstly deflected drops are captured in a gutter, this approach also creates a more uniform airflow pattern in the gas deflection and drop capture zone of the printhead since the many drops that correspond to "white" or "blank" areas of the image pattern will fly on both sides of the fewer, undeflected, print drops.

For the purpose of understanding the present inventions it is necessary only to recognize that the application of asymmetric heat at the nozzle of a continuous jet can deflect the jet. Practically achievable deflection amounts are of the order of a few degrees. For the present inventions it is assumed that thermal deflection or deflection by other means to be discussed below, achieves deflections of 0.5 to 2.0 degrees away from the nominal, undeflected flight paths of undeflected drop streams.

Figure 9:
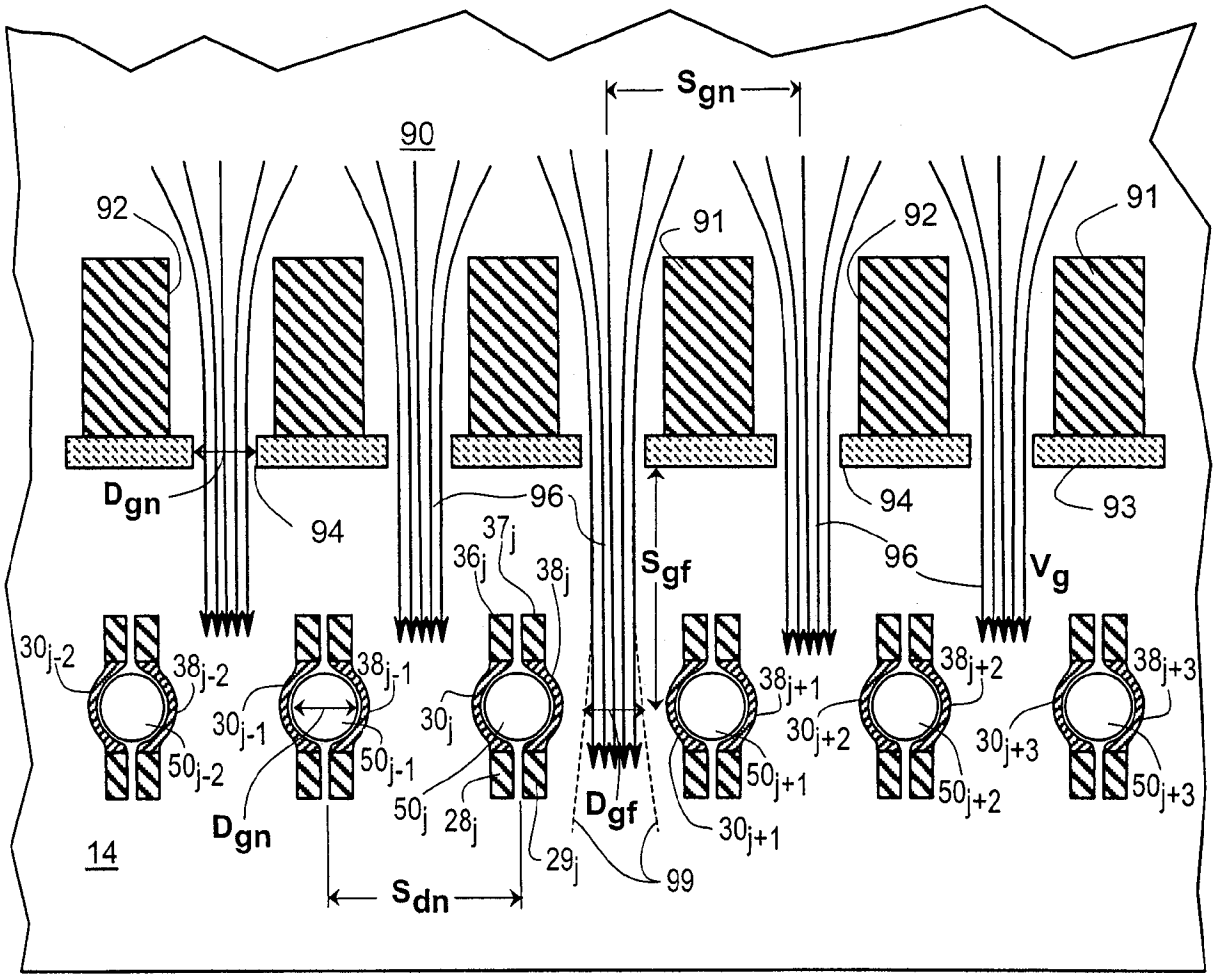
FIG. 9 shows a schematic front view of a portion of a printhead having a plurality of streams of drops and a localized gas flow per jet to secondly deflect drops according to the present inventions.

FIG. 9 illustrates the position and function of the gas deflection apparatus. A portion of a drop generator showing an array of drop nozzles 50 with side heaters 30, 38 is illustrated in front face view. A gas deflector assembled with the drop generator as shown in FIG. 2 is shown in cross-sectional view through a row of gas flow nozzles 94 in FIG. 9. Several aspects of the gas deflector apparatus previously discussed are illustrated. An array of gas flow nozzles 94 having effective gas nozzle diameters, $D_{gn}$, are aligned to an array of drop nozzles 50 in interdigitated fashion so that the localized gas flows 96 are directed to positions between the drop nozzles. That is, for the preferred embodiment illustrated in FIG. 9, the gas nozzle spacing, $S_{gn}$, and the drop nozzle spacing, $S_{dn}$, are equal, $S_{gn}=S_{dn}$.

The intended position of the localized gas flows is particularly indicated by the flow drawn between drop nozzles $\mathbf{50}_j$ and $\mathbf{50}_{j+1}$. The array of gas flow nozzles is positioned a distance $S_{gf}$ away from the drop nozzle array axis. Pressurized gas 90 is forced through the gas flow nozzles 94, creating a localized jet of gas having a peak velocity of $V_g$, and a spatially diverging, generally Gaussian profile 99. For the purposes of the present inventions, an important design parameter is the effective cross-sectional diameter, $D_{gf}$, of the localized gas flow 96 at the distance $S_{gf}$ from the gas flow nozzle plate 93. The effective cross-sectional diameter of the localized gas flow 96 is designated as the effective diameter of the first standard deviation in gas velocity as measured or calculated from modeling. Typically, the diameter of the gas flow, $D_{gf}$, is less than twice the uniform drop diameter, $D_d$, being emitted, that is, $D_{gf}<2\ D_d$. For increased latitude to variations in gas flow nozzle diameters, shapes and gas distribution manifold pressure variations, it is preferable to design the localized gas flow diameter to be equal to or less than the operating drop diameter, $D_{gf}\leqq D_d$. This condition is met if the gas nozzle effective diameter is equal to or less than the drop nozzle diameter, $D_{gn}\leqq D_{dn}$, and the spacing $S_{gf}$ is approximately 20 $D_{gn}$ or less, $S_{gf}\leqq D_{dn}$.

Figure 10:
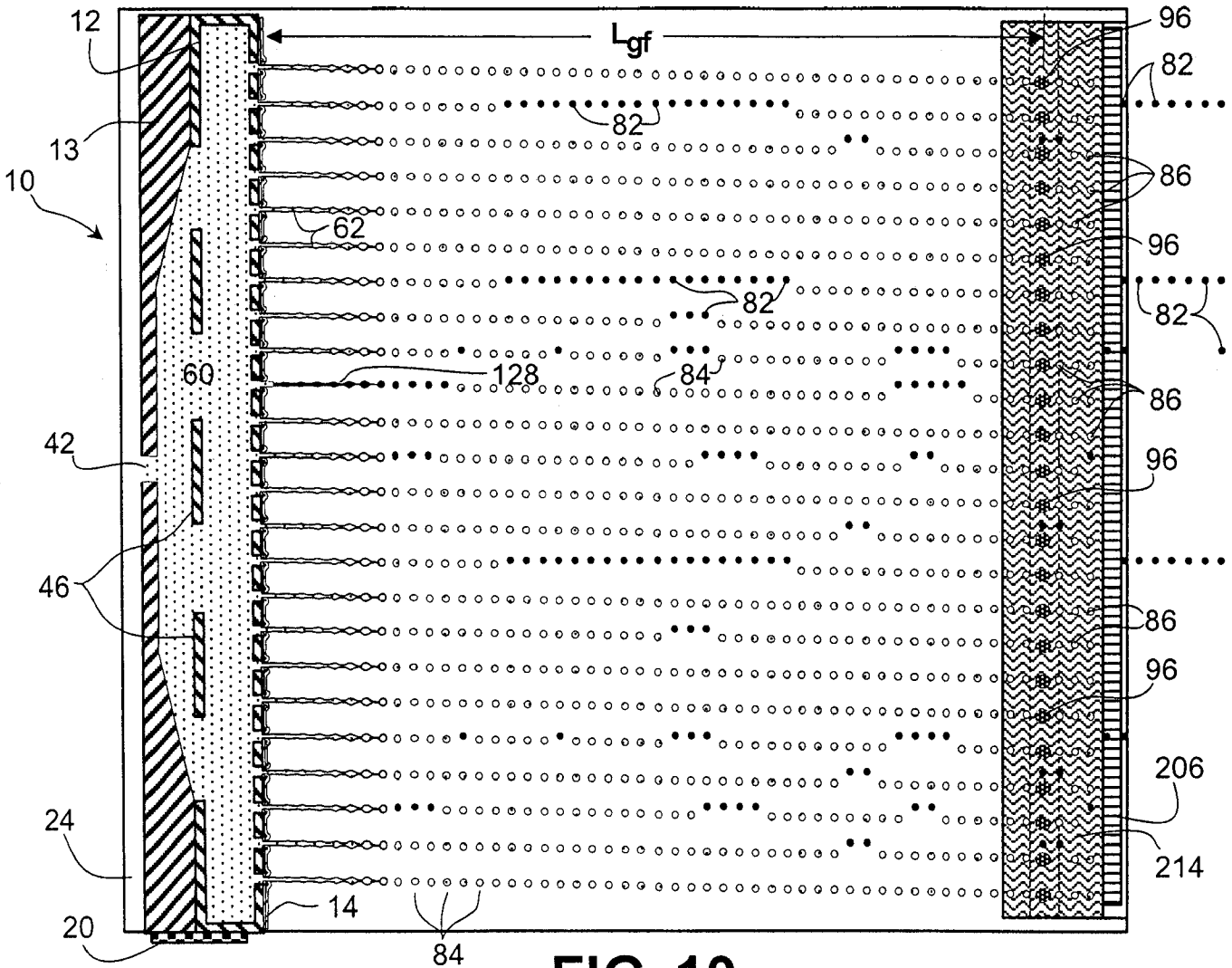
FIG. 10 shows a schematic top view of a printhead having a plurality of streams of drops and a localized gas flow per jet to secondly deflect drops according to the present inventions.

FIG. 10 illustrates in top cross-sectional view the operation of some preferred embodiments of the present as also illustrated in above discussed FIG. 9. FIG. 10 illustrates a printhead 10 as shown in with the gas deflector apparatus removed and a cross section taken large through the drop nozzle array and parallel to the plane of nominal, undeflected, drop paths. In FIG. 10, drops 82, following a nominal, undeflected flight path after emission from their respective nozzle and synchronized break-up, are drawn in solid fill. All drops are emitted in substantially a same plane that is perpendicular to the front face nozzle layer 14. Nominal flight path drops 82 are allowed to pass through the printhead and emerge to be deposited on the receiver medium 300 located to the left and out of view (not shown) in FIG. 10. All of the drops 82, drawn in solid fill, are "print" drops and will combine to form the desired liquid pattern on the receiver medium. Fluid column 128 is drawn in solid fill to indicate that the drops that will form at break-off from that already emitted fluid will also travel the nominal flight pat to the receiver media. That is, all of the fluid in fluid column 128 will end up forming part of the desired liquid pattern.

Many drops 84, drawn as open fill, are firstly deflected by side deflectors such as the heater resistors discussed above in connection with FIGS. 3-8. FIG. 10 depicts drops 84 as firstly deflected slight downwardly, at approximately a 1° angle with respect to the nominal flight path, in FIG. 10. While deflected to the side, the firstly deflected fluid travels a first deflection flight path that remains substantially within the nominal drop flight path plane. Based on liquid pattern data, open fill drops 84 are deflected towards side one by means of an asymmetric deflection apparatus, such as heater resistors $\mathbf{30}_j$ and $\mathbf{38}_j$ illustrated in FIG. 10. The energy pulse train illustrated in FIG. 6(*b*) applied to the side one and side two heaters $\mathbf{30}_j$ and $\mathbf{38}_j$ will cause the deflection of a drop volume segment of fluid away from side two heater $\mathbf{38}_j$ and towards side two heater $\mathbf{38}_j$. For the preferred embodiments of the present inventions illustrated by FIG. 10, drops that would otherwise deposit at the blank pixel areas of the desired liquid pattern are deflected by the first deflection apparatus.

The slight first deflection imparted to the fluid forming drops 84 accumulates to an "off-axis" amount of approximately one-half the drop nozzle spacing $S_{dn}$ after traveling the distance $L_{gf}$, the position of the localized gas flows 96. Typically, first deflection means will impart approximately a deflection of 0.5° to 2.0° to the fluid at the nozzle. Therefore $L_{gf}$ will typically be in the following range:

$$L_{gf} \approx \frac{S_{dn}}{2\tan(0.5^\circ \text{ to } 2.0^\circ)}, \text{ or} \tag{1}$$

$$14S_{dn} \leq L_{gf} \leq 60S_{dn}, \tag{2}$$

where $S_{dn}$ is the drop nozzle spacing. For drop nozzle spacing in the range 84 microns to 21 microns, $L_{gf}$ will be typically in the range: 300 microns to 4800 microns. For a preferred embodiment wherein the nozzle spacing is ~42 microns for 600 dpi printing and the first deflection is ~1°, $L_{gf}$~1200 microns according to Equations 1 and 2.

Localized gas flows 96 are indicated in FIG. 10 as shaded circles, interdigitated between the flight paths of nominal drops 82. When firstly deflected drops 84 are impinged by the localized gas flows they are secondly deflected downwardly towards the porous landing surface 214 of the fluid capture apparatus 200 illustrated in FIG. 2. The secondly deflected drops 86 are captured either by landing surface 214 or impinge the fluid capture manifold below gutter lip 206. Thus none of the firstly deflected drops 84 are allowed to fly past gutter lip 206. Only undeflected drops 82, flying along nominal flight paths, emerge from printhead 10 and subsequently deposit on the receiver medium 300 (not shown).

The localized gas flows 96 are designed to impart minimal deflection to undeflected drops 82 so as not to cause errors in the landing positions of the liquid pattern forming drops 82. Gas flows 96 may set up a low velocity, generally uniform, gas flow that slightly and equally deflects all drops following nominal flight paths. Such uniform deflection of printing drops is acceptable and has the affect of slightly shifting the position of liquid pattern formation relative to the receiving medium. However, the velocity of deflection gas flows, where they intersect the flight paths of nominal drops, is constrained by design so that the undeflected drops 82 are not substantially deflected out of the nominal flight plane in a pattern-data-dependent fashion. A substantial pattern-dependent deflection would be one that shifted the landing point of a drop by more than 30% of a raster distance.

In FIG. 10 all of the firstly deflected drops 84 are illustrated as traveling towards side one for gas deflection by the localized gas flow 96 located on the side one of each jet. Alternate embodiments of the present inventions may be configured to use first deflection towards both sides of a jet. That is, drops may be directed towards the localized gas flows 96 on either side of a given jet for subsequent deflection towards a drop capture subsystem. First deflection to both sides of a jet may be advantageous in setting up more uniform air flow patterns in the zone of gas flow deflection and drop capture.

Figure 11:
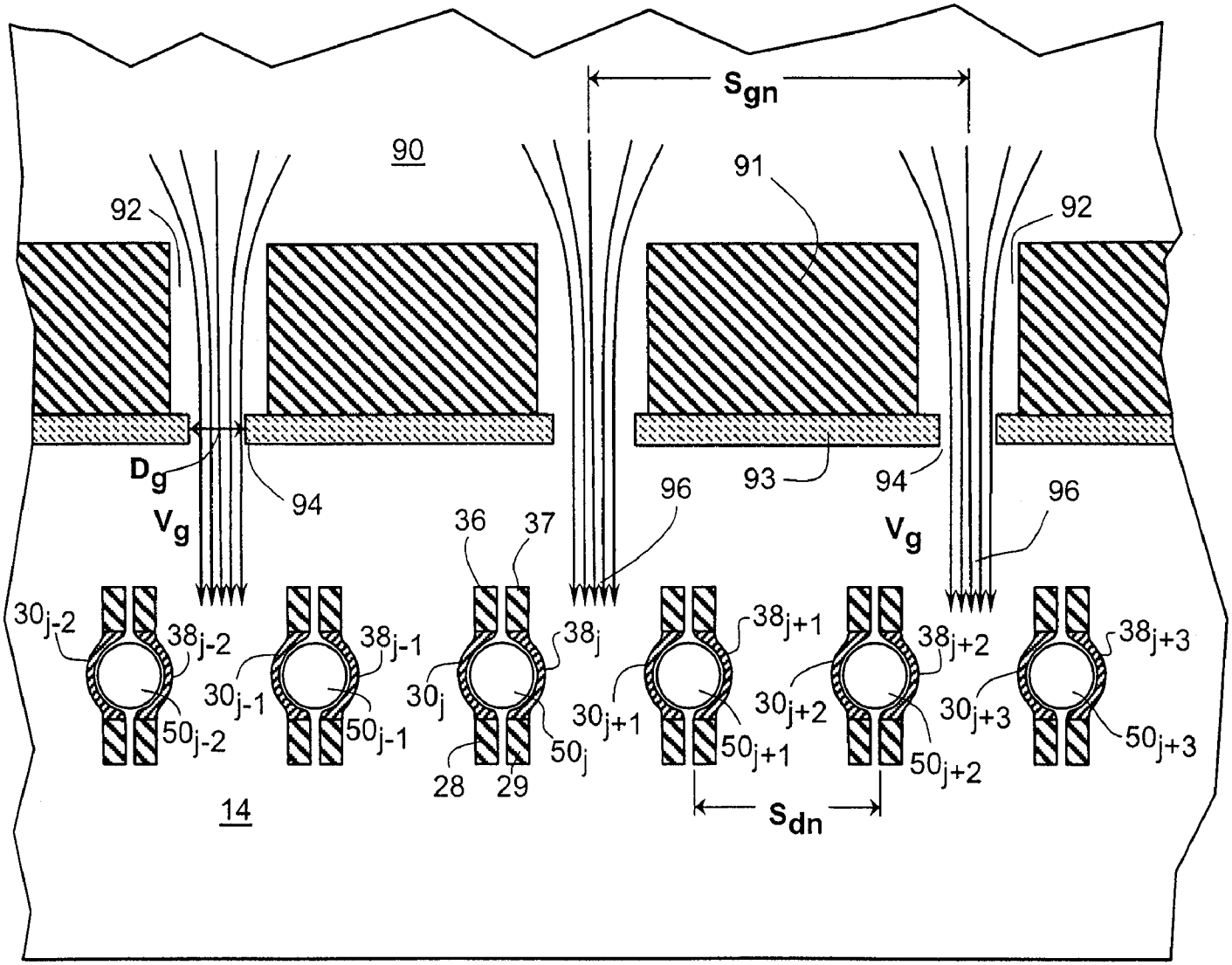
FIG. 11 shows a schematic front view of a portion of a printhead having a plurality of streams of drops and a localized gas flow shared by two adjacent jets to secondly deflect drops according to the present inventions.
Figure 12:
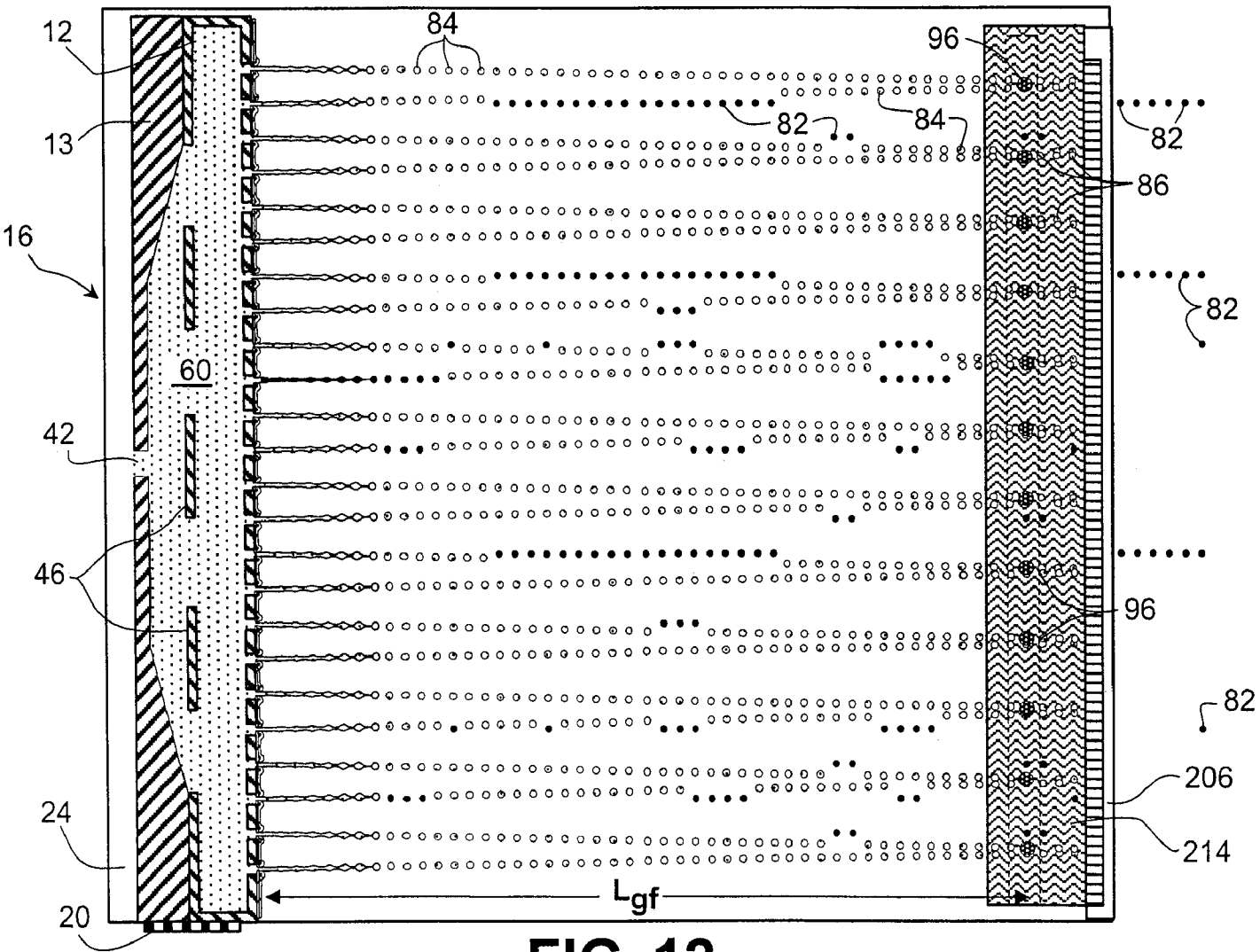
FIG. 12 shows a schematic top view of a printhead having a plurality of streams of drops and a localized gas flow shared by two adjacent jets to secondly deflect drops according to the present inventions.

An alternative preferred embodiment of the present inventions is illustrated in FIGS. 11 and 12. For these embodiments the gas deflector apparatus is configured with localized gas flow nozzles at one-half the density, twice the spacing, of drop nozzles, $S_{gf}=2\ S_{dn}$. In operation the embodiments illustrated by FIGS. 11 and 12 function identically to those illustrated and previously discussed in conjunction with FIGS. 9 and 10, except that pairs of adjacent fluid streams are firstly deflected towards each other so that firstly deflected drops 84 travel along first deflection flight paths that converge at a single, "shared" localized gas flow areas 96. As for the previously discussed embodiment, all firstly deflected drops 84 are secondly deflected 86 to a landing surface 214 of a fluid capture apparatus or impinge the fluid capture manifold below gutter lip 206. Undeflected drops 82 are allowed to emerge from printhead 16 to form the desired liquid pattern on the receiver medium 300 (not shown).

Figure 13:
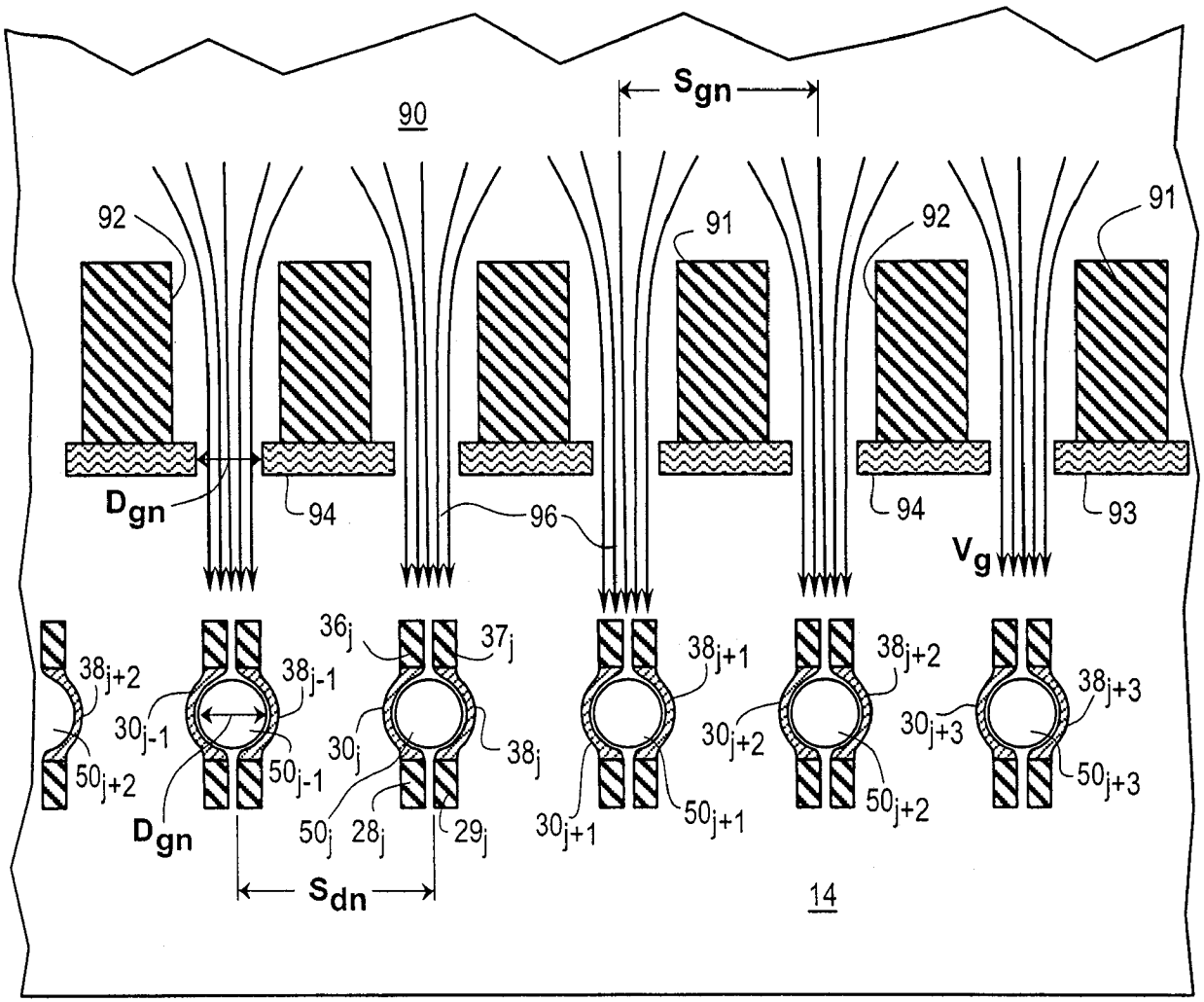
FIG. 13 shows a schematic front view of a portion of a printhead having a plurality of streams of drops and a localized gas flows aligned with the nominal drop flight paths to secondly deflect drops according to the present inventions.

Further preferred embodiments of the present inventions are illustrated in FIG. 13. For these embodiments the gas deflector apparatus is configured with localized gas flow nozzles at the same density and spacing of drop nozzles, $S_{gf}=S_{dn}$, and, further, are directly aligned with the drop nozzles as may be understood from FIG. 13. In operation the embodiments illustrated by FIG. 13 function identically to those illustrated and previously discussed in conjunction with FIGS. 9 and 10, except that drops intended to form the liquid pattern are firstly deflected and drops that are to be captured by the fluid capture apparatus are not firstly deflected. Instead, non-printing drops fly along nominal flight paths until they encounter the localized gas flow areas 96 located at distance $L_{gf}$ straight downstream whereat they are secondly deflected toward the fluid capture apparatus as illustrated in side view in FIG. 2. Drops to be printed according to liquid pattern data are firstly deflected by an asymmetric deflection means at the nozzle so that they travel along first deflection paths between localized gas flow areas.

For these embodiments wherein firstly deflected drops are used to form the liquid pattern, the localized gas flows 96 are designed to impart minimal deflection to firstly deflected drops so as not to cause errors in the landing positions of these liquid pattern forming drops. The velocity of deflection gas flows, where they intersect the flight paths of firstly deflected drops, is constrained by design so that the firstly deflected drops 82 are not substantially deflected out of the nominal flight plane in a pattern-data-dependent fashion. A substantial pattern-dependent deflection would be one that shifted the landing point a drop by more than 30% of a raster distance.

Figure 14:
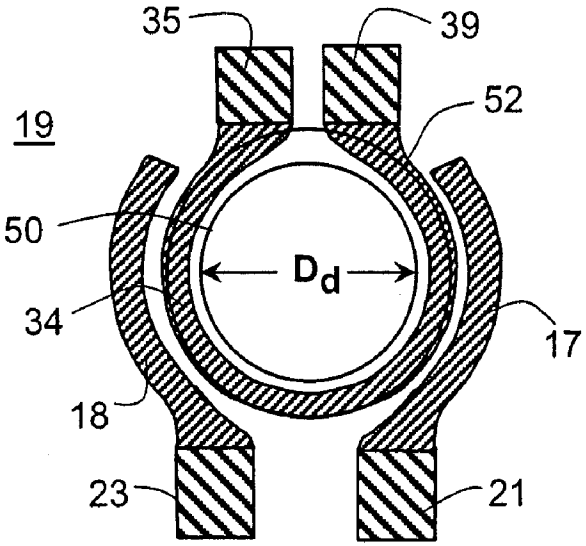
FIGS. 14(*a*) and 14(*b*) shows a schematic front view and a top view of an electrostatic deflection apparatus for firstly deflecting drops according to a preferred embodiment of the present invention.
Figure 14:
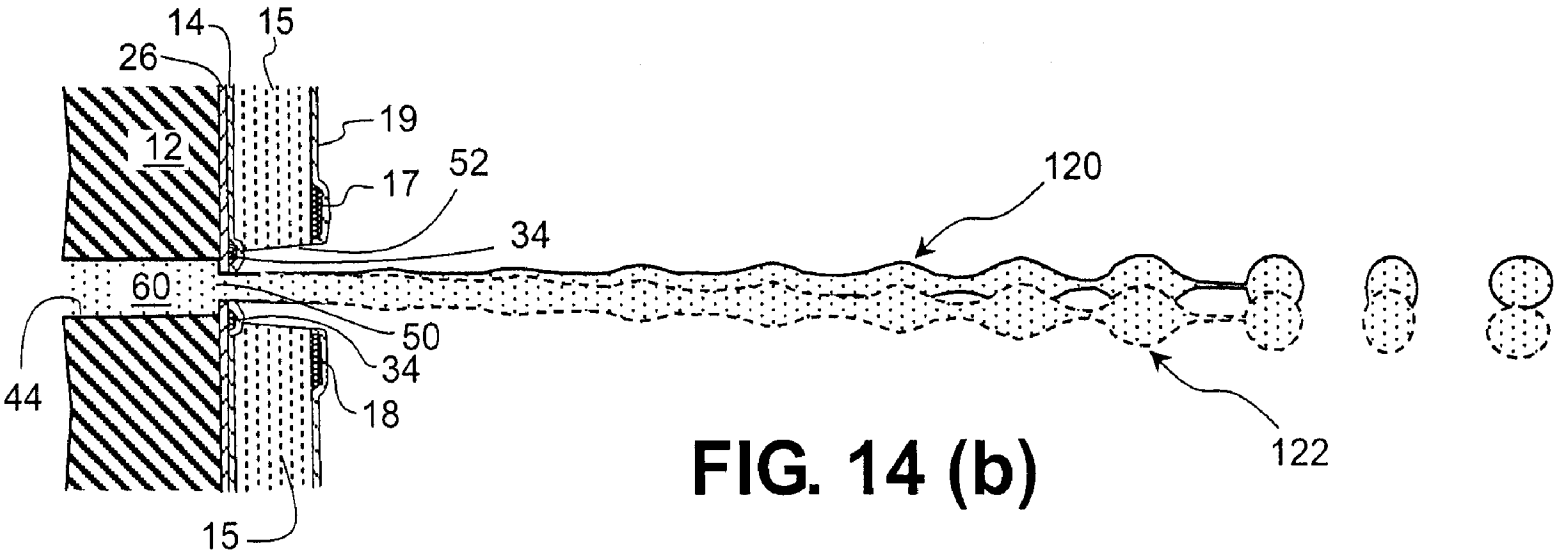

Additional embodiments of the present inventions may be configured using asymmetric first deflection means other than the resistive heaters apparatus discussed heretofore. FIGS. 14(*a*) and 14(*b*) illustrate an electrostatic deflection apparatus that may be used to perform the first deflection. FIG. 14(*a*) shows in front face view a single drop nozzle 50 that is surrounded by both a heater resistor 34 and side one and side two electrostatic deflection electrodes 18 and 17. The resistive heater is addressed by leads 35 and 39 and is used to synchronize stream break-up by thermal stimulation, as has been discussed above. Side one electrostatic deflection electrode 18 is addressed by lead 23 and side two electrostatic deflection electrode 17 is addressed by lead 21. By applying a differential voltage to the electrostatic deflection electrodes 17, 18, the stream fluid opposite the electrodes may be attracted to one side or the other by inducing charge on the fluid column. The emitted liquid must be sufficiently conductive that induced charges may form well within in the time frame of individual drop generation.

FIG. 14(*b*) illustrates in side view first deflection using electrostatic forces. In the illustrated case the fluid in the stream is intermittently deflected towards the first side electrode 18, shown as a phantom line fluid and drop stream 122. Electrostatic deflection electrodes 17 and 18 are formed in front of the drop nozzle 50 by first applying a dielectric spacer layer 15 and then depositing a conductor material for the deflection electrodes and then over coating the leads and electrodes with a passivation coating 19. Passivation coating 19 is preferably hydrophobic. Some air gap spacing between the electrostatic deflection electrodes 17, 18 and the unbroken fluid column must be maintained. Also the electrostatic deflection electrodes are positioned to operate on the unbroken fluid column so that induced charges may be drawn to the fluid via the conducting fluid. Typically the drop generator and pressurized fluid are held at ground potential. However, any arrangement of voltage differences that results in an appreciable electrostatic force on the fluid in the jet may be used. Electrostatic deflection of an unbroken continuous fluid column is known and disclosed in Chawlek '917.

Electrostatic first deflection may be used in combination with any of the embodiments of the gas deflection subsystem and fluid capture subsystem previously discussed. A liquid patterning apparatus equipped with asymmetric electrostatic first deflection will function in analogous fashion to one equipped with asymmetric resistive heating. That is, the system may be configured to print with undeflected drops as discussed in connection with FIGS. 9 and 10 or with firstly deflected drops as was discussed in association with FIG. 13.

Figure 15:
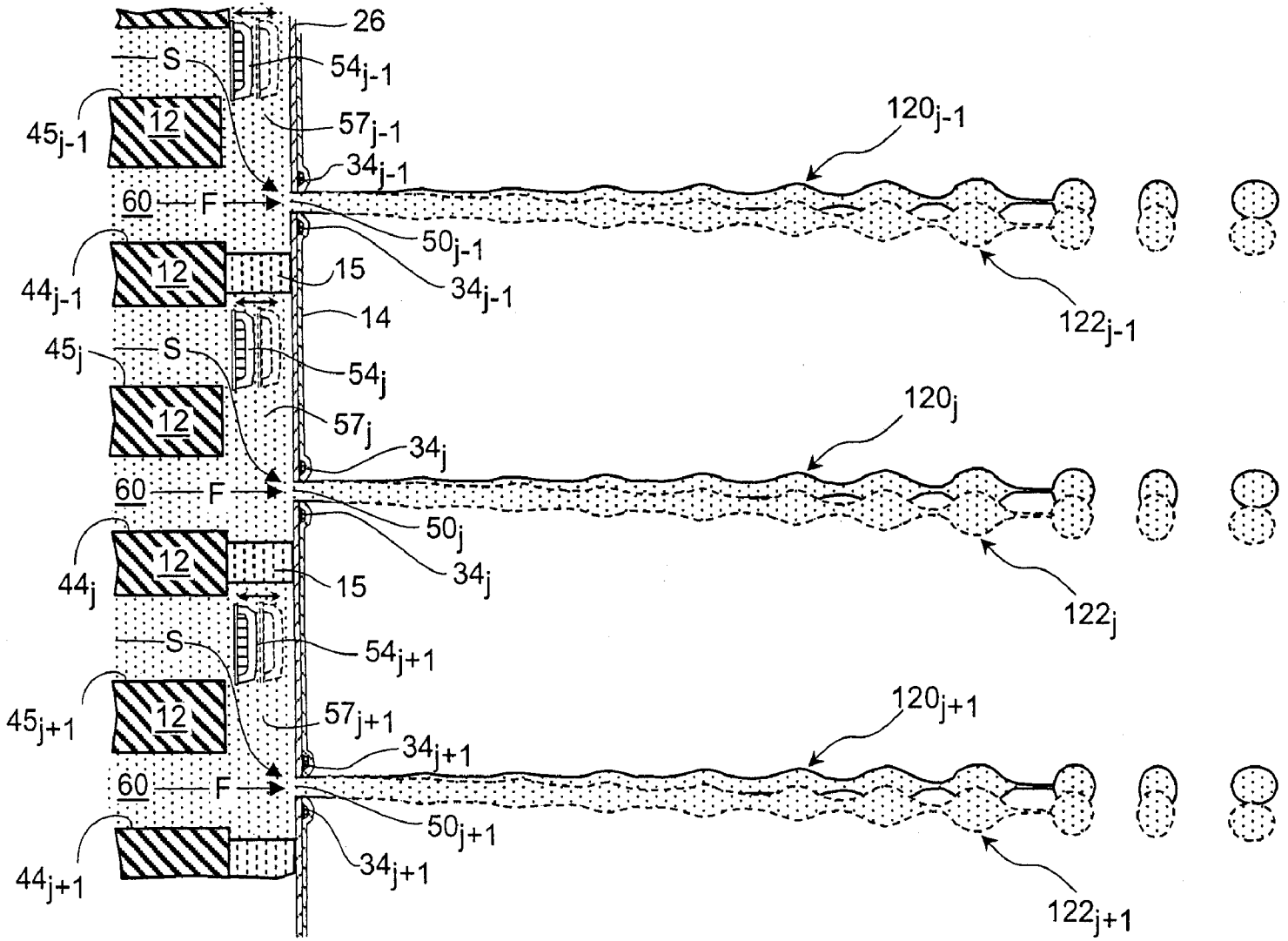
FIG. 15 shows a schematic top view of a fluid flow valve apparatus for firstly deflecting drops according to a preferred embodiment of the present invention.
Figure 16:
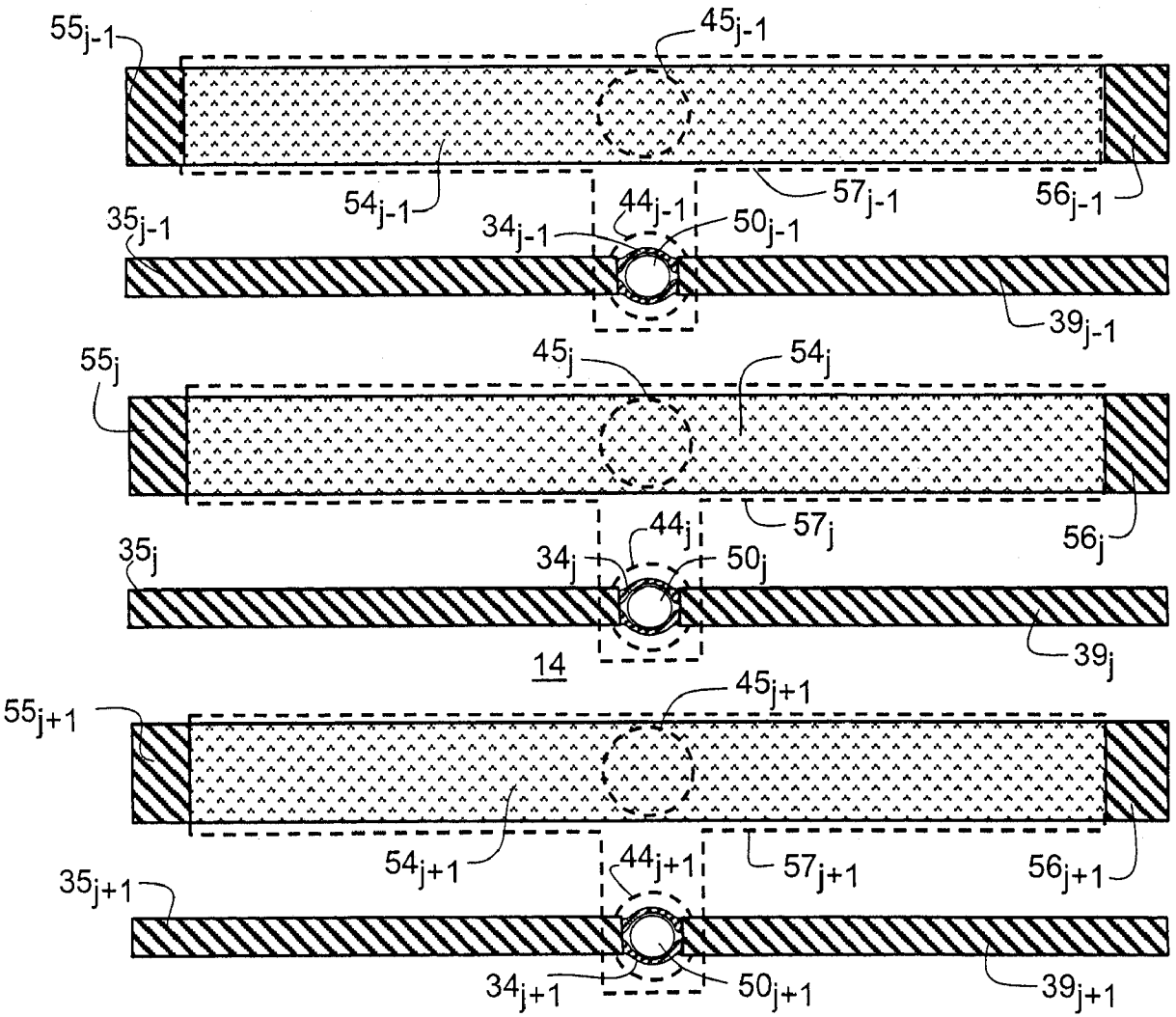
FIG. 16 shows a schematic front view of a fluid flow valve apparatus for firstly deflecting drops according to a preferred embodiment of the present invention.

FIGS. 15 and 16 illustrate another set of embodiments of the present inventions wherein the first deflection is accomplished by manipulating the local liquid flow into each nozzle based on pattern data. To accomplish this microfluid flow, each nozzle is supplied with pressurized liquid 60 that follows a main path F, or, additionally, a secondary, off-axis path S behind the nozzle. The secondary off-axis fluid supply is controlled by a plurality of microvalves corresponding to the plurality of drop nozzles $\mathbf{50}_j$.

A side view of the nozzle region of such a drop generator is illustrated in FIG. 15. In this side view it may be seen that each nozzle $\mathbf{50}_j$ has an adjacent fluid cavity $\mathbf{57}_j$ that is in immediate flow communication with the nozzle and formed in spacer layer 15. Fluid cavity $\mathbf{57}_j$ is supplied with pressurized liquid via a main flow separation passage $\mathbf{44}_j$ directly behind nozzle $\mathbf{50}_j$. In addition, pressurized fluid 60 may reach fluid cavity $\mathbf{57}_j$ via a second flow separation passage $\mathbf{45}_j$ if microelectromechanical valve actuator $\mathbf{54}_j$ is opened. For the configuration illustrated, "open" means that the valve closure actuator is moved towards the drop nozzle forming layer 14 as indicated by the phantom line depiction valve closure actuator $\mathbf{54}_j$ and arrow. When flow is admitted to fluid cavity $\mathbf{57}_j$ by opening the closure actuator $\mathbf{54}_j$, the fluid supply to nozzle $\mathbf{50}_j$ becomes asymmetric, causing the fluid to be emitted at an angle relative to the front face nozzle layer 14. The intermittent change in the angle of emission caused by intermittently allowing the secondary fluid supply flow is illustrated by the "deflected" stream of fluid 122 drawn in phantom lines.

The microvalve structure of FIG. 15 is further illustrated in front plane view in FIG. 15. FIG. 15 also shows a heater resistor $\mathbf{34}_j$ for each nozzle $\mathbf{50}_j$ having address leads $\mathbf{35}_j$ and $\mathbf{39}_j$. Resistive heater $\mathbf{34}_j$ is used to thermally stimulate each fluid column for synchronous break-up as has been discussed for both thermal and electrostatic first deflection above. Microvalve closure actuator $\mathbf{54}_j$ is illustrated as a beam anchored at address electrodes $\mathbf{55}_j$ and $\mathbf{56}_j$. Fluid cavity $\mathbf{57}_j$ also encompasses the unanchored portion of valve closure beam actuator $\mathbf{54}_j$ so as to permit the necessary opening and closing movement indicated in side view in FIG. 15. A variety of microvalve configurations is known and may be applied to the present inventions. The microvalve actuator is preferably based on thermomechanical or piezoelectric expansion of the beam element in response to a current or voltage pulse applied by the printhead transducer circuits, based on liquid pattern data.

The plurality of valve closure actuators are opened and closed based on liquid pattern data. The result is a set of drops that travel along nominal flight paths when the valve is closed or along first deflection paths when the valve is opened. Microfluid flow first deflection may be used in combination with any of the embodiments of the gas deflection subsystem and fluid capture subsystem previously discussed. A liquid patterning apparatus equipped with asymmetric microfluid flow first deflection will function in analogous fashion to one equipped with asymmetric resistive heating. That is, the system may be configured to print with undeflected drops as discussed in connection with FIGS. 9 and 10 or with firstly deflected drops as was discussed in association with FIG. 13.

Methods of liquid pattern deposition that utilize localized gas flow for secondary drop deflection may be apparent from the above discussion of the numerous apparatus embodiments of the present inventions. For sake of clarity, some preferred methods of forming a liquid pattern on a medium are illustrated schematically in FIGS. 17 and 18.

Figure 17:
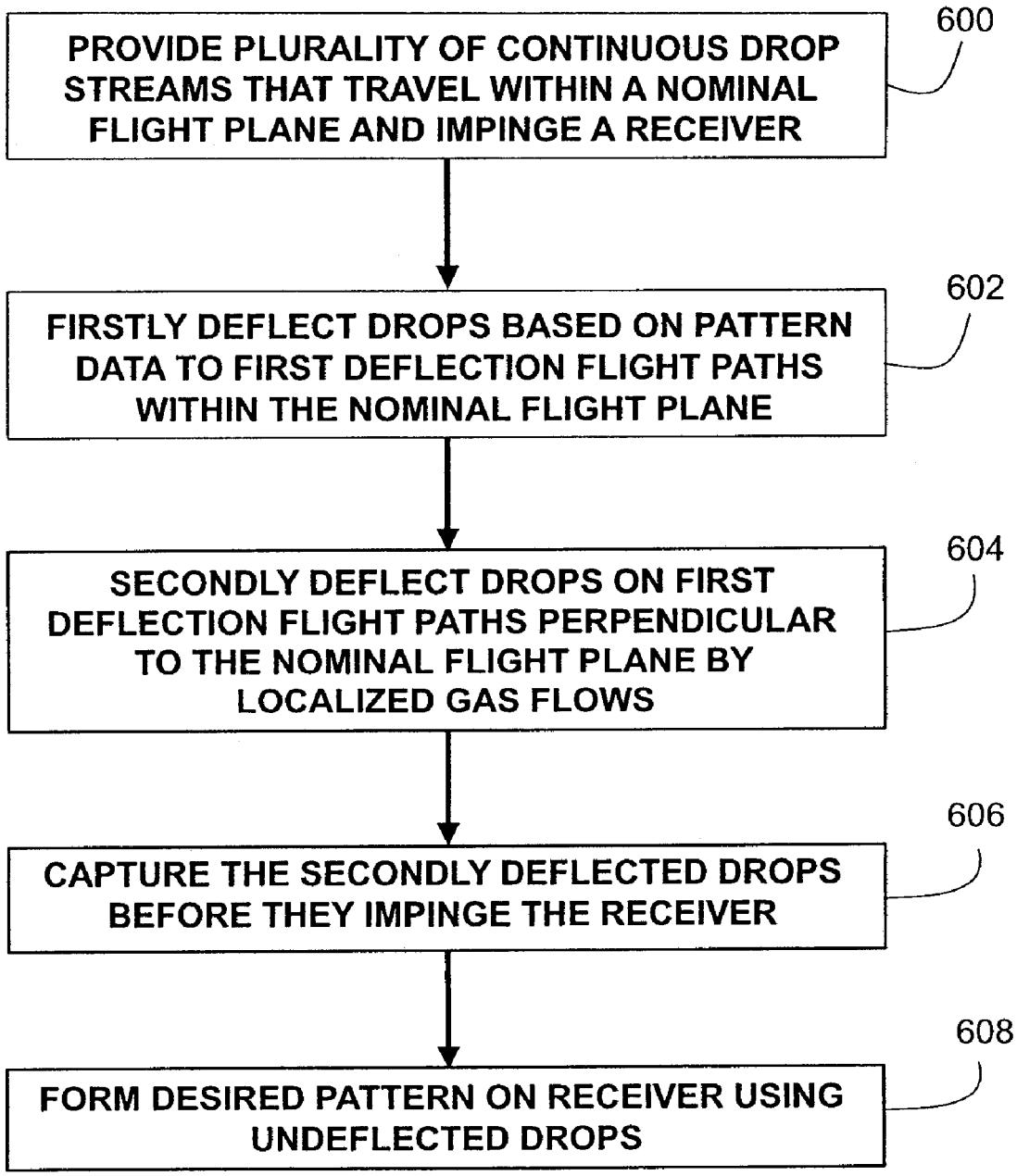
FIG. 17 illustrates a method of liquid pattern deposition according to the present inventions in which firstly deflected drops are secondly deflected and captured before impinging the medium.

In the set of methods schematically illustrated in FIG. 17, a plurality of continuous drops streams that travel within a nominal flight plane and impinge a receiver medium is provided at step 600. Such a set of drop streams is illustrated, for example, in FIGS. 10 and 12. Based on the data describing the desired liquid pattern, drops are either firstly deflected or not within the nominal flight plane in step 602. Many different first deflection apparatus may be employed. Preferred embodiments discussed previously include asymmetric thermal heating of the fluid exiting each nozzle, asymmetric electrostatic attraction of the each individual fluid column, or asymmetric microflow supplied to each nozzle using a plurality of microelectromechanical valves. The firstly deflected drops are secondly deflected by localized gas flows in a direction perpendicular to the nominal flight plane in step 604. Secondly deflected drops are captured before they can travel to the receiver medium in step 606. Undeflected drops are allowed to emerge and impact the receiver medium to form the desired liquid pattern in step 608.

Figure 18:
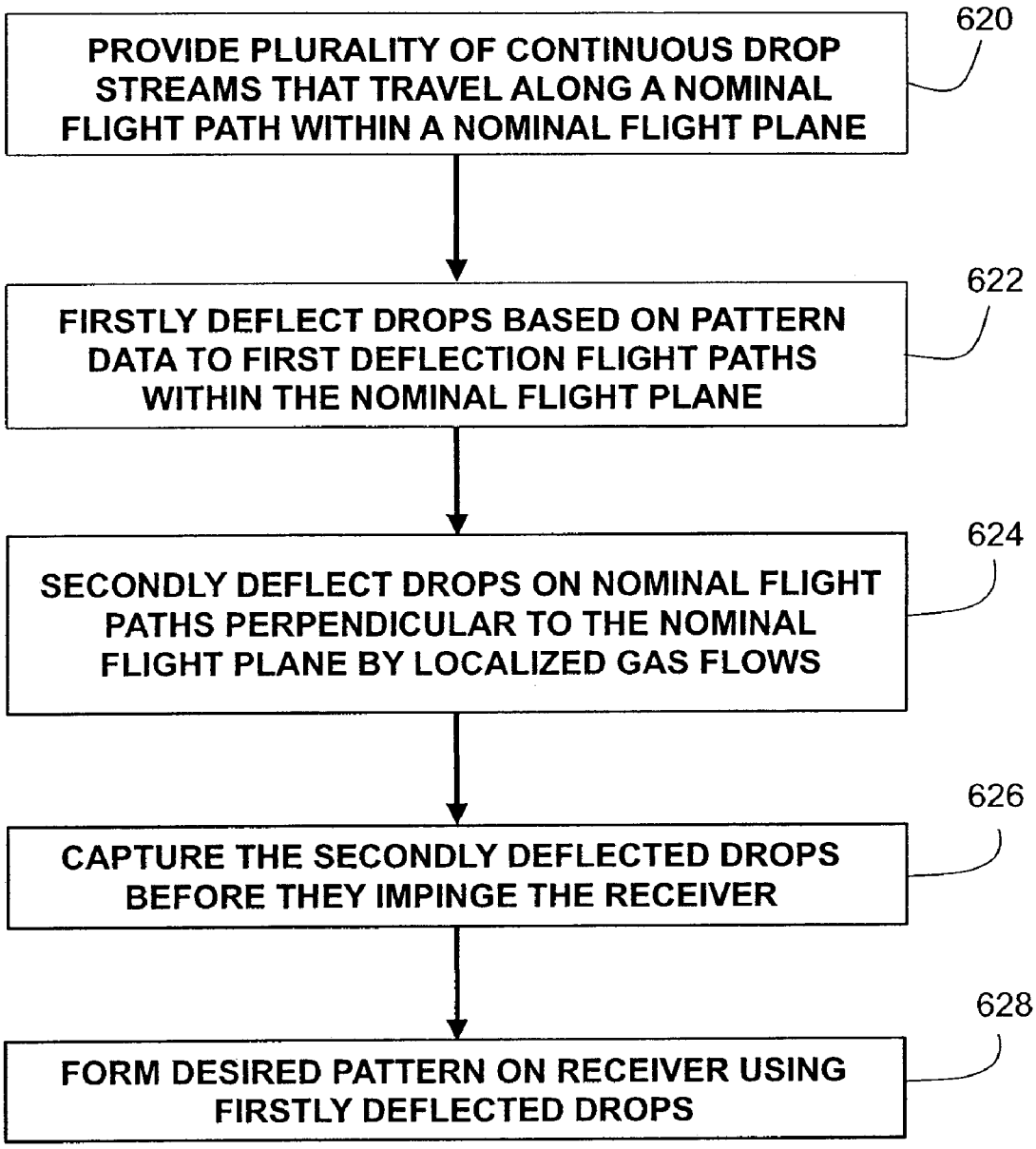
FIG. 18 illustrates a method of liquid pattern deposition according to the present inventions in which the firstly deflected drops are not secondly deflected and impinge the medium.

In the set of methods schematically illustrated in FIG. 18, a plurality of continuous drops streams that travel within a nominal flight plane and impinge a receiver medium is provided at step 620. Such a set of drop streams is illustrated, for example, in FIGS. 10 and 12. Based on the data describing the desired liquid pattern, drops are either firstly deflected or not within the nominal flight plane in step 622. Many different first deflection apparatus may be employed. Preferred embodiments discussed previously include asymmetric thermal heating of the fluid exiting each nozzle, asymmetric electrostatic attraction of the each individual fluid column, or asymmetric microflow supplied to each nozzle using a plurality of microelectromechanical valves. The undeflected drops are secondly deflected by localized gas flows in a direction perpendicular to the nominal flight plane in step 624. Secondly deflected drops are captured before they can travel to the receiver medium in step 626. Firstly drops are allowed to emerge and impact the receiver medium to form the desired liquid pattern in step 628.

The inventions have been described in detail with particular reference to certain preferred embodiments thereof, but it will be understood that variations and modifications can be effected within the spirit and scope of the inventions.

PARTS LIST

10 continuous liquid drop emission printhead
11 drop generator back plate
12 drop generator substrate
14 drop nozzle front face layer
15 dielectric spacer layer
16 continuous drop printhead with shared gas flow deflection regions
17 first nozzle side electrostatic deflection electrode
18 second nozzle side electrostatic deflection electrode
19 electrode passivation layer
20 electrical connector input to printhead circuitry
21 first deflection electrode address lead
23 second deflection electrode address lead
24 printhead mounting plate
26 thermal and electrical isolation layer
28 nozzle side two heater address electrode
29 nozzle side one heater address electrode
30 nozzle side one heater resistor
34 thermal stimulation heater resistor
36 nozzle side one heater address electrode
35 stimulation heater address electrode
37 nozzle side two heater address electrode
38 nozzle side two heater resister
39 stimulation heater address electrode
40 pressurized liquid supply manifold
42 pressurized liquid inlet port
44 pressurized liquid flow separation passageway
45 secondary liquid flow passageway for deflection flow
46 strength members formed in substrate 12
48 pressurized liquid supply chamber
50 nozzle opening
52 opening in dielectric spacer layer 15
54 MEMS valve closure element
55 MEMS valve closure element address lead
56 MEMS valve closure element address lead
57 fluid cavity formed in dielectric spacer layer 15
60 positively pressurized liquid
62 continuous stream of liquid
64 natural surface waves on the continuous stream of liquid
66 drops of undetermined volume
68 guttered fluid
70 stimulated surface waves on the continuous stream of liquid
76 operating break-off length due to controlled stimulation
77 natural break-off length
78 break-off length line across a stimulated array before break-off control
80 drops of predetermined volume
82 undeflected drops following nominal flight path to medium
84 firstly deflected drops deflected laterally by thermal effects
86 firstly deflected drops secondly deflected by localized gas flow
90 pressurized gas for gas deflection system
91 gas distribution manifold
92 gas flow separation passageway
93 gas flow nozzle layer
94 gas flow nozzle opening
95 pressurized gas inlet
96 localized gas flows for individual drop deflection
97 gas distribution manifold cover
98 gas deflector apparatus
99 envelope of first standard deviation in localized gas flow velocity
100 stream of drops of undetermined volume from natural break-up
120 undeflected stream of drops of predetermined volume
122 stream of drops deflected to a first side by asymmetric stream heating
124 stream of drops deflected to a second side by asymmetric stream heating
126 stream of drops deflected by localized gas flows to a capture apparatus
200 fluid capture apparatus to capture drops and gas flows
202 captured fluid return passage
204 porous media component for drop landing and gas flow capture
206 drop capture or gutter lip
208 outlet to vacuum source from liquid recycling subsystem
210 captured deflection gas flows and ambient gas capture
212 localized gas flow capture slot in porous media component 204
220 fluid capture manifold
250 media transport input drive means
252 media transport output drive means

300 print or deposition plane
400 controller
410 input data source
412 printhead transducer drive circuitry
414 media transport control circuitry
416 liquid recycling subsystem including vacuum source
418 liquid supply reservoir
420 deflection gas source
422 gas deflection subsystem control circuitry
424 liquid supply subsystem control circuitry

The invention claimed is:

1. A drop deflector apparatus for a continuous drop emission system that deposits a liquid pattern on a receiver, comprising:

(a) a plurality of drop nozzles emitting a plurality of continuous streams of a liquid that breaks up into streams of drops of substantially uniform drop volume having nominal flight paths that are substantially parallel and substantially within a nominal flight plane;

(b) a plurality of path selection elements corresponding to the plurality of continuous streams of drops operable to firstly deflect individual drops from the corresponding continuous stream of drops along a first deflection flight path diverging from the nominal flight path based on liquid pattern data; and (c) a plurality of gas nozzles which generate a plurality of localized gas flows, positioned along one of the first deflection flight paths or the nominal flight paths, wherein the localized gas flows are oriented so as to cause a substantial second deflection of one of the firstly deflected drops or the nominal drops in a direction perpendicular to the nominal flight plane without causing a substantial deflection of drops following the other of the first deflection flight paths or the nominal flight paths.

2. The liquid drop deflection apparatus according to claim 1, wherein the first deflection flight paths are substantially within the nominal flight path.

3. The liquid drop deflection apparatus according to claim 1, wherein the plurality of drop nozzles are spaced equally along a drop nozzle array axis in a drop nozzle plane; the plurality of gas nozzles are equally spaced along a gas nozzle array axis in a gas nozzle plane; and the drop nozzle plane and the gas nozzle plane are not parallel.

4. The liquid drop deflection apparatus according to claim 3, wherein the number of gas nozzles is equal to the number of drop nozzles.

5. The liquid drop deflection apparatus according to claim 3, wherein plurality of localized gas flows are positioned along first deflection flight paths and the number of gas nozzles is equal to one-half the number of drop nozzles.

6. The liquid drop deflection apparatus according to claim 3, wherein the drop nozzle plane is perpendicular to the nominal flight plane and the gas nozzle plane is substantially parallel to the nominal flight plane.

7. The liquid drop deflection apparatus according to claim 3, wherein the drop nozzles are equally spaced apart a distance $S_{dn}$ along the drop nozzle array axis and the gas nozzle array axis is arranged to be parallel to and spaced apart from the drop nozzle plane by a gas nozzle array spacing, $L_{gf}$, and wherein $14\ S_{dn} \leqq L_{gf} \leqq 60\ S_{dn}$.

8. The liquid drop deflection apparatus according to claim 1, wherein the path selection elements comprise a heater apparatus that non-uniformly heats the corresponding continuous stream of liquid.

9. The liquid drop deflection apparatus according to claim 8, wherein the heater apparatus applies pulses of heat energy that cause the plurality of continuous streams to break up into streams of drops at substantially uniform time intervals and the heat energy applied during each time interval for each continuous stream is substantially equal.

10. The liquid drop deflection apparatus according to claim 1, wherein the path selection elements comprise an electrostatic force apparatus that attracts the corresponding continuous stream of liquid in the direction of the first deflection flight path.

11. The liquid drop deflection apparatus according to claim 1, wherein the path selection elements comprise a flow valve in a fluid path leading to the corresponding continuous stream of liquid wherein the flow valve is operable to cause an asymmetric flow through the corresponding one of the plurality of drop nozzles.

12. The liquid drop deflection apparatus according to claim 1, wherein the plurality of drop nozzles have an effective drop nozzle opening area and the plurality of gas nozzles have an effective gas nozzle opening area that is equal to or smaller than twice the drop nozzle opening area.

13. The liquid drop deflection apparatus according to claim 1, wherein drops have a nominal drop velocity, $V_d$, and the plurality of gas flows have a nominal gas velocity, $V_g$, at the gas nozzle, wherein $5V_d \leqq V_g \leqq 50\ V_d$.

14. The liquid drop deflection apparatus according to claim 1, further comprising a drop catcher position to capture drops that are secondly deflected by the plurality of localized gas flows.

15. The liquid drop deflection apparatus according to claim 1, wherein the liquid is used to form a liquid pattern on a medium and the liquid pattern is comprised of drops that are not deflected by the plurality of localized gas flows.

16. A method of forming a liquid pattern on a medium based on pattern data, comprising:

(a) providing a plurality of drop nozzles emitting a plurality of continuous streams of drops having a substantially uniform drop volume and having nominal flight paths that are substantially parallel, substantially within a nominal flight plane and that impinge the medium;

(b) firstly deflecting individual drops having the substantially uniform drop volume from the plurality of continuous streams of drops, based on liquid pattern data, along first deflection flight paths that diverge from the nominal flight path while remaining substantially within the nominal flight plane;

(c) secondly deflecting drops having the substantially uniform drop volume and traveling along one of the first deflection flight paths or the nominal flight paths in a direction perpendicular to the nominal flight plane by a plurality of localized gas flows without causing a substantial deflection of drops having the substantially uniform drop volume and following the other of the first deflection flight paths or the nominal flight paths; and (d) capturing the secondly deflected drops in a drop catcher thereby forming the liquid pattern on the media comprised of drops that are not secondly deflected.

17. The method of forming a liquid pattern on a medium based on pattern data according to claim 16 wherein the step of firstly deflecting individual drops uses a plurality of path selection elements corresponding to the plurality of continuous streams of drops.

18. The method of forming a liquid pattern on a medium based on pattern data according to claim 16, wherein the path selection elements comprise at least one of a heater apparatus that non-uniformly heats the corresponding continuous stream of liquid, an electrostatic force apparatus that attracts the corresponding continuous stream of liquid in the direction of the first deflection flight path, or a flow valve in a fluid path leading to the corresponding continuous stream of liquid wherein the flow valve is operable to cause an asymmetric flow through the corresponding one of the plurality of drop nozzles.

19. A method of forming a liquid pattern on a medium based on pattern data comprising:

(a) providing a plurality of drop nozzles emitting a plurality of continuous streams of drops of substantially uniform drop volume having nominal flight paths that are substantially parallel, substantially within a nominal flight plane and that impinge the medium;

(b) firstly deflecting individual drops from the plurality of continuous streams of drops, based on liquid pattern data, along first deflection flight paths that diverge from the nominal flight path while remaining substantially within the nominal flight plane;

(c) secondly deflecting drops traveling along one of the first deflection flight paths or the nominal flight paths in a direction perpendicular to the nominal flight plane by a plurality of localized gas flows without causing a substantial deflection of drops following the other of the first deflection flight paths or the nominal flight paths; and (d) capturing the secondly deflected drops in a drop catcher thereby forming the liquid pattern on the media comprised of drops that are not secondly deflected, wherein the plurality of drop nozzles are spaced equally along a drop nozzle array axis, the plurality of localized gas flows is created by a plurality of gas nozzles that are equally spaced along a gas nozzle array axis; and the number of gas nozzles is equal to the number of drop nozzles.

20. A method of forming a liquid pattern on a medium based on pattern data comprising:

(a) providing a plurality of drop nozzles emitting a plurality of continuous streams of drops of substantially uniform drop volume having nominal flight paths that are substantially parallel, substantially within a nominal flight plane and that impinge the medium;

(b) firstly deflecting individual drops from the plurality of continuous streams of drops, based on liquid pattern data, along first deflection flight paths that diverge from the nominal flight path while remaining substantially within the nominal flight plane;

(c) secondly deflecting drops traveling along one of the first deflection flight paths or the nominal flight paths in a direction perpendicular to the nominal flight plane by a plurality of localized gas flows without causing a substantial deflection of drops following the other of the first deflection flight paths or the nominal flight paths; and (d) capturing the secondly deflected drops in a drop catcher thereby forming the liquid pattern on the media comprised of drops that are not secondly deflected, wherein the plurality of drop nozzles are spaced equally along a drop nozzle array axis, the plurality of localized gas flows is created by a plurality of gas nozzles that are equally spaced along a gas nozzle array axis, drops traveling along first deflection flight paths are secondly deflected, and the number of gas nozzles is equal one-half the number of drop nozzles.

21. A method of depositing a liquid pattern on a receiver in a drop deflector apparatus for a continuous drop emission system, comprising:

(a) emitting, from a plurality of drop nozzles, a plurality of continuous streams of a liquid that breaks up into streams of drops of substantially uniform drop volume having nominal flight paths that are substantially parallel and substantially within a nominal flight plane;

(b) firstly deflecting, via a plurality of path selection elements corresponding to the plurality of continuous streams of drops, individual drops from the corresponding continuous stream of drops along a first deflection flight path diverging from the nominal flight path based on liquid pattern data; and (c) generating a plurality of localized gas flows, via a plurality of gas nozzles, along one of the first deflection flight paths or the nominal flight paths, wherein the localized gas flows are oriented so as to cause a substantial second deflection of one of the firstly deflected drops or the nominal drops in a direction perpendicular to the nominal flight plane without causing a substantial deflection of drops following the other of the first deflection flight paths or the nominal flight paths.

* * * * *

UNITED STATES PATENT AND TRADEMARK OFFICE

CERTIFICATE OF CORRECTION

PATENT NO. : 7,413,293 B2
APPLICATION NO. : 11/417458
DATED : August 19, 2008
INVENTOR(S) : Jeanmaire It is certified that error appears in the above-identified patent and that said Letters Patent is hereby corrected as shown below:

Column 19, line 37 In Claim 2, delete "path" and insert --plane--.

Signed and Sealed this

Twentieth Day of April, 2010

David J. Kappos

David J. Kappos
*Director of the United States Patent and Trademark Office*